US010663902B2

(12) United States Patent
Horiguchi et al.

(10) Patent No.: US 10,663,902 B2
(45) Date of Patent: May 26, 2020

(54) GLOSS REDUCTION IN IMAGE POST-PROCESSING METHOD, IMAGE POST-PROCESSING APPARATUS, AND IMAGE FORMING APPARATUS

(71) Applicant: Konica Minolta, Inc., Tokyo (JP)

(72) Inventors: Haruo Horiguchi, Koganei (JP); Seijiro Takahashi, Kokubunji (JP); Toyoko Shibata, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/186,002

(22) Filed: Nov. 9, 2018

(65) Prior Publication Data

US 2019/0171148 A1 Jun. 6, 2019

(30) Foreign Application Priority Data

Dec. 4, 2017 (JP) ..... 2017-232240

(51) Int. Cl.
*G03G 15/00* (2006.01)
*G03G 15/20* (2006.01)
*G03G 15/22* (2006.01)

(52) U.S. Cl.
CPC ..... *G03G 15/5062* (2013.01); *G03G 15/2021* (2013.01); *G03G 15/50* (2013.01); *G03G 15/6582* (2013.01); *G03G 15/6585* (2013.01); *G03G 15/2007* (2013.01); *G03G 15/22* (2013.01); *G03G 2215/0081* (2013.01); *G03G 2215/00426* (2013.01); *G03G 2215/00805* (2013.01)

(58) Field of Classification Search
CPC ..... G03G 13/20; G03G 15/2007; G03G 15/2021; G03G 15/22; G03G 15/50; G03G 15/5062; G03G 15/6582; G03G 15/6585; G03G 2215/00426; G03G 2215/00805; G03G 2215/0081
See application file for complete search history.

(56) References Cited

U.S. PATENT DOCUMENTS

2004/0057741 A1* 3/2004 Uehara ..... G03G 15/2064 399/69
2013/0243503 A1* 9/2013 Hirayama ..... G03G 15/2021 399/341
2013/0278952 A1* 10/2013 Suzuki ..... G06K 15/02 358/1.9

FOREIGN PATENT DOCUMENTS

JP 2007072022 A 3/2007

* cited by examiner

*Primary Examiner* — Joseph S Wong
(74) *Attorney, Agent, or Firm* — Lucas & Mercanti, LLP

(57) ABSTRACT

There is disclosed an image post-processing method for adjusting glossiness of a fixed toner image. The image post-processing method includes a glossiness control step of, with a non-contact heating device, heating a toner image fixed to a recording medium so as to reduce glossiness of the toner image. The non-contact heating device is configured to heat the toner image fixed to the recording medium to a temperature which reduces the glossiness of the fixed toner image.

14 Claims, 6 Drawing Sheets

GLOSS REDUCTION IN IMAGE POST-PROCESSING METHOD, IMAGE POST-PROCESSING APPARATUS, AND IMAGE FORMING APPARATUS

BACKGROUND

1. Technological Field

The present invention relates to an image post-processing method, an image post-processing apparatus and an image forming apparatus. More specifically, the present invention relates to an image post-processing method, an image post-processing apparatus and an image forming apparatus which can adjust glossiness of toner images with no influence on fixability of the toner images.

2. Description of the Related Art

In recent years, recording media where images are formed have been diversified in type. For example, high quality paper and coated paper are different from one another in surface shape, and accordingly different from one another in gloss (glossiness). Further, in a case where a toner image is formed on a recording medium, if glossiness of a portion where the image is formed (image portion) is greatly different from that of a portion where the image is not formed (no-image portion), namely, a bare portion of the recording medium, a user(s) may feel something strange.

Then, there is known a fixing device for controlling glossiness of toner images. The fixing device changes a toner-image fixing temperature, thereby choosing/switching between glossing a toner image(s) and not glossing the toner image(s). (Refer to, for example, JP 2007-72022 A.) However, in this case, where glossiness of toner images is controlled by the fixing temperature, when glossiness of a toner image is to be reduced, the amount of heat to be given to the toner image is not enough to fix the toner image to a recording medium, and hence fixing strength of the toner image to the recording medium is insufficient.

SUMMARY

The present invention has been conceived in view of the above problems and circumstances, and objects of the present invention include providing an image post-processing method, an image post-processing apparatus and an image forming apparatus which can adjust glossiness of toner images with no influence on fixability of the toner images.

In order to achieve at least one of the objects, according to an aspect of the present invention, there is provided an image post-processing method for adjusting glossiness of a fixed toner image, including: a glossiness control step of, with a non-contact heating device configured to heat a toner image fixed to a recording medium to a temperature which reduces glossiness of the fixed toner image, heating the toner image fixed to the recording medium so as to reduce the glossiness of the toner image.

BRIEF DESCRIPTION OF THE DRAWINGS

The advantages and features provided by one or more embodiments of the present invention will become more fully understood from the detailed description given hereinbelow and the appended drawings which are given by way of illustration only, and thus are not intended as a definition of the limits of the present invention, wherein.

DETAILED DESCRIPTION OF EMBODIMENTS

Figure 1:
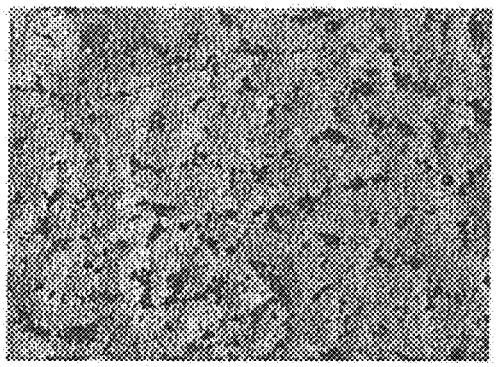
FIG. 1 is an observation view showing a state of the surface of a toner image fixed to a recording medium before a glossiness control step.

Hereinafter, one or more embodiments of the present invention will be described with reference to the drawings. However, the scope of the present invention is not limited to the disclosed embodiments.

An image post-processing method of the present invention is an image forming post-processing method for adjusting glossiness of a fixed toner image(s), including a glossiness control step of, with a non-contact heating device configured to heat a toner image(s) fixed to a recording medium (media) to a temperature which reduces glossiness of the fixed toner image, heating the toner image fixed to the recording medium so as to reduce the glossiness of the toner image. These features are technical features shared by or corresponding to the embodiments below.

According to the present invention, there can be provided an image post-processing method, an image post-processing apparatus and an image forming apparatus which can adjust glossiness of toner images with no influence on fixability of the toner images.

An expression mechanism or an action mechanism of the effects of the present invention is as follows.

The present inventors have found out that heating a toner image(s) fixed to a recording medium (media) with a non-contact heating device, thereby re-softening or re-melting the toner, can change the state of the surface of the toner image and can control glossiness of the toner image.

More specifically, for example, if a toner image fixed to a recording medium is heated by the non-contact heating device to a temperature which does not re-melt but softens the toner, elasticity of the toner of the toner image is recovered, and irregularity on the surface of the toner image is increased, so that the glossiness of the toner image can be reduced.

On the other hand, if the toner image is heated to a temperature which re-melts the toner, the entire toner image becomes smooth, so that the glossiness can be increased compared to that before heating.

Thus, heating toner images with the non-contact heating device can control the glossiness of the toner images.

Further, because heating toner images with the non-contact heating device does not block the toner images from protruding due to the elasticity recovery of the toner images, this can adjust the glossiness of the toner images.

Further, because the image post-processing method of the present invention can control the glossiness of the fixed toner images by heating the fixed toner images with the non-contact heating device, it can control the glossiness of the toner images with no influence on the fixability of the toner images.

As an embodiment of the present invention, preferably, the non-contact heating device is further configured to heat the toner image fixed to the recording medium to a temperature which increases the glossiness of the toner image, and the glossiness control step includes a step of, with the non-contact heating device, heating the toner image fixed to the recording medium so as to reduce or increase the glossiness of the toner image.

As an embodiment of the present invention, preferably, a surface temperature of the toner image when the glossiness of the toner image is reduced is equal to or lower than a softening temperature of a toner constituting the toner image. This can efficiently recover the elasticity of the toner constituting the toner image without meting the toner, and reduce the glossiness of the toner image.

As an embodiment of the present invention, preferably, the surface temperature of the toner image when the glossiness of the toner image is reduced or increased is in a range of −30° C. to +100° C., inclusive, of the softening temperature of a toner constituting the toner image. The surface temperature being equal to or higher than −30° C. of the softening temperature can efficiently soften the toner and make it easy to change the glossiness, whereas the surface temperature being equal to or lower than +100° C. of the softening temperature can suppress excessive melt of the toner and make it hard to generate image unevenness of the toner image.

As an embodiment of the present invention, preferably, the glossiness control step includes a temperature control step of adjusting the surface temperature of the toner image with the non-contact heating device based on glossiness information specified by a user. This can adjust the surface temperature for the glossiness specified by a user.

As an embodiment of the present invention, preferably, in the temperature control step, the surface temperature of the toner image is adjusted based on relationship information on change in the glossiness of the toner image with respect to the surface temperature of the toner image. This can perform the heating such that the surface temperature of the toner image can be the surface temperature for the glossiness specified by the user, so that the glossiness can be adjusted more precisely.

As an embodiment of the present invention, preferably, the image post-processing method further includes, before the glossiness control step, a step of detecting the glossiness of the toner image fixed to the recording medium. This can adjust the glossiness more accurately.

An image post-processing apparatus of the present invention is an image post-processing apparatus for adjusting glossiness of a fixed toner image(s), including: the non-contact heating device configured to heat a toner image(s) fixed to a recording medium (media) to the temperature which reduces glossiness of the toner image; and a hardware processor which causes the non-contact heating device to heat the toner image fixed to the recording medium so as to reduce the glossiness of the toner image.

As an embodiment of the image post-processing apparatus of the present invention, preferably, the non-contact heating device is further configured to heat the toner image fixed to the recording medium to the temperature which increases the glossiness of the toner image, and the hardware processor causes the non-contact heating device to heat the toner image fixed to the recording medium so as to reduce or increase the glossiness of the toner image.

An image forming apparatus of the present invention is an image forming apparatus which forms an electrophotographic image(s), including: a transfer unit which transfers, onto a recording medium (media), a toner image(s) formed in a developing unit; a fixing unit which fixes the toner image to the recording medium; the non-contact heating device configured to heat the toner image fixed to the recording medium to the temperature which reduces glossiness of the toner image; and the hardware processor which causes the non-contact heating device to heat the toner image fixed to the recording medium so as to reduce the glossiness of the toner image.

As an embodiment of the image forming apparatus of the present invention, preferably, the non-contact heating device is further configured to heat the toner image fixed to the recording medium to the temperature which increases the glossiness of the toner image, and the hardware processor causes the non-contact heating device to heat the toner image fixed to the recording medium so as to reduce or increase the glossiness of the toner image.

An image forming apparatus of the present invention is an image forming apparatus which forms an electrophotographic image(s), including: the transfer unit which transfers, onto a recording medium (media), a toner image(s) formed in the developing unit; and the fixing unit which fixes the toner image to the recording medium, wherein the image post-processing apparatus of the present invention is attached to the image forming apparatus.

Hereinafter, the present invention and elements thereof as well as configurations and embodiments for carrying out the present invention will be described in detail. In this application, "-(to)" between numerical values is used to mean that the numerical values before and after the sign are inclusive as the lower limit and the upper limit.

[Image Post-Processing Method]

An image post-processing method of the present invention is an image post-processing method for adjusting glossiness of fixed toner images, and has a glossiness control step of, with a non-contact heating device configured to heat toner images fixed to recording media to a temperature which reduces glossiness of the toner images, heating toner images fixed to recording media so as to reduce glossiness of the toner images.

It is preferable that the non-contact heating device according to the present invention be configured to heat toner images fixed to recording media not only to the temperature which reduces the glossiness of the toner images but also to a temperature which increases the glossiness of the toner images, and the glossiness control step have a step of, with the non-contact heating device, heating toner images fixed to recording media so as to reduce or increase the glossiness of the toner images.

The non-contact heating device in the present invention is a heating device configured to heat toner images fixed to recording media without directly contacting the surfaces of the toner images. Examples of the non-contact heating device include a device for heating by infrared rays with a heater or the like, a device for heating by hot air blowing, a device for heating with a heating plate, and a device for heating by light emission.

In the case of the device for heating with a heating plate, for example, by placing a side of a recording medium on the heating plate, the side where no toner image is formed, a toner image formed on the other side of the recording medium can be heated. In this case, the toner image and the heating plate do not contact one another directly. That is, because the toner image and the heating plate do not contact one another, the heating plate is included in the scope of the non-contact heating device in the present invention.

<Glossiness Control Step>

The glossiness control step according to the present invention is preferably a step of, with the non-contact heating device, heating a toner image(s) fixed to a recording medium (media), thereby re-softening or re-melting the toner, so as to change the state of the surface of the toner image and hence reduce or increase glossiness of the toner image. The glossiness control step according to the present invention is a step in which the glossiness can be reduced at least.

In the glossiness control step, for example, when the non-contact heating device heats the fixed toner image to a temperature which does not re-melt but softens the toner, elasticity of the fixed toner is recovered, which increases irregularity on the surface of the image. Consequently, the glossiness becomes lower than that before heating.

On the other hand, when the non-contact heating device heats the fixed toner image to a temperature which re-melts the toner, the entire toner image becomes smooth. Consequently, the glossiness becomes higher than that before heating.

Figure 2:
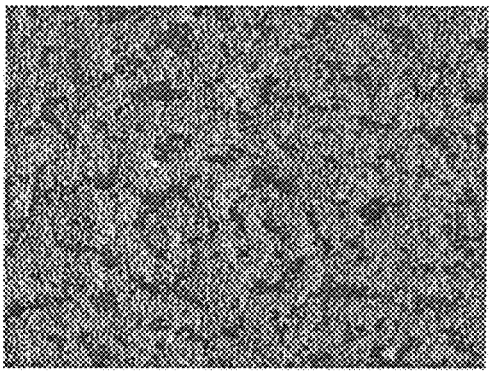
FIG. 2 is an observation view showing a state of the surface of the toner image heated by a non-contact heating device to a temperature which does not re-melt but softens toner of the toner image.
Figure 3:
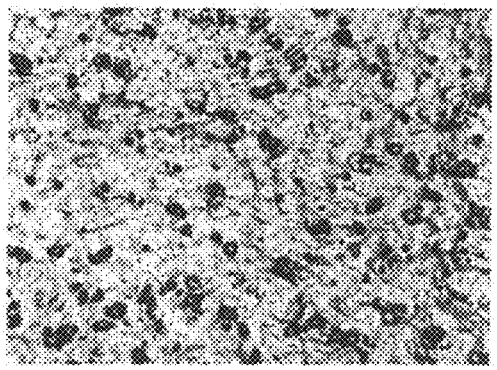
FIG. 3 is an observation view showing a state of the surface of the toner image heated by the non-contact heating device to a temperature which re-melts the toner.

FIG. 1 to FIG. 3 show images obtained by observing, under a laser microscope, a toner image formed on a recording medium.

FIG. 1 shows a state of the surface of the toner image fixed to the recording medium before the glossiness control step.

FIG. 2 shows a state of the surface of the toner image shown in FIG. 1 heated by the non-contact heating device to the temperature which does not re-melt but softens the toner. As shown in FIG. 2, when elasticity of the fixed toner is recovered by the heating, irregularity on the surface of the toner image is increased, so that the glossiness becomes lower than that before heating.

FIG. 3 shows a state of the surface of the toner image shown in FIG. 1 heated by the non-contact heating device to the temperature which re-melts the toner. As shown in FIG. 3, when the toner is re-melted by the heating, the entire toner image becomes smooth, so that the glossiness becomes higher than that before heating.

It is preferable that the glossiness control step have a temperature control step of adjusting, with the non-contact heating device, surface temperature of the toner image (hereinafter may be referred to as "toner image surface temperature") on the basis of glossiness information specified by a user.

The "glossiness information specified by a user" in the present invention is information which specifies how a user wishes to adjust the glossiness of the toner image. For example, it may be a specific numerical value of the glossiness, a result of selection about by how much the glossiness is reduced or increased from the current glossiness, or a result of simple selection about whether to reduce or increase the glossiness from the current glossiness.

The glossiness information may be set by the user with an input screen or the like when an image post-processing apparatus performs glossiness control or when an image forming apparatus performs image printing, for example.

It is preferable, in the temperature control step, to adjust the surface temperature of the toner image on the basis of relationship information on change in the glossiness of the toner image with respect to the surface temperature of the toner image. This can perform the heating such that the surface temperature of the toner image can be the surface temperature for the glossiness specified by the user, so that the glossiness can be adjusted more precisely.

Figure 4:
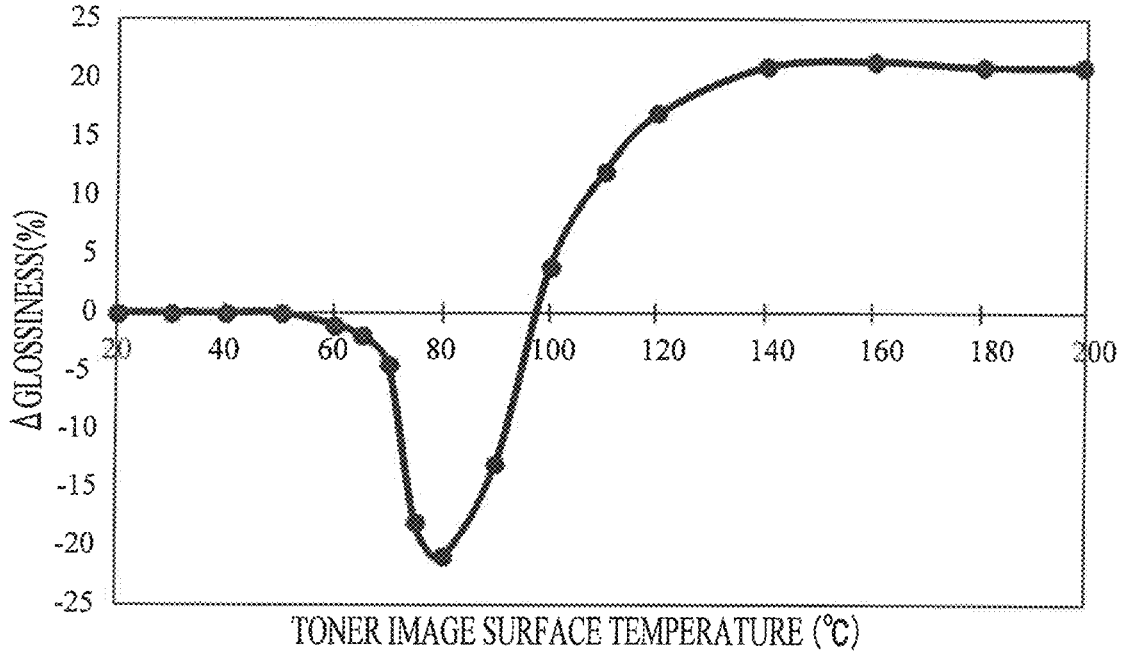
FIG. 4 is a graph showing change in glossiness (%) of a toner image with respect to surface temperature (° C.) of the toner image.

The relationship information on change in the glossiness of the toner image with respect to the surface temperature of the toner image is, for example, a graph as shown in FIG. 4. FIG. 4 is a graph showing change in the glossiness (Δ glossiness (%)) of a toner image(s) with respect to the surface temperature of the toner image(s). The temperature is the surface temperature. The graph in FIG. 4 shows not actual measured values but typical values schematically, and numerical values on the horizontal axis and the vertical axis are shown for purposes of illustration. In the case shown in FIG. 4, a softening temperature of the toner constituting the toner image is 99° C.

The graph shown in FIG. 4 can be created, for example, as follows: raise the surface temperature of the toner image to a predetermined temperature; and plot change in the glossiness with respect to the surface temperature of the toner image.

The surface temperature of the toner image can be measured, for example, with a thermometer (product name FT-H10 manufactured by KEYENCE CORPORATION).

The glossiness can be obtained, for example, by, with a gloss meter (Multi Gloss 268Plus manufactured by Konica Minolta, Inc.), measuring the glossiness (%) at an incident angle of 60° at five points in total on the toner image irradiated with glossiness control light, and calculating the average value of the five points as the glossiness (%). The five points are: the center point of the image; and two points in each of the up and down directions of the long axis direction at 50 mm intervals from the center point of the image.

If the graph shown in FIG. 4 is used to adjust the glossiness, the toner image surface temperature for the glossiness specified by the user is selected, and the toner image is heated so as to have the selected surface temperature. Consequently, the glossiness can be adjusted to desired glossiness.

There may be two or more temperatures as the surface temperature of the toner image to change the current glossiness to the specified glossiness. For example, in the case shown in FIG. 4, in order to reduce the glossiness by about 10%, the toner image may be heated so as to have a surface temperature of about 70° C. or a surface temperature of about 90° C. In such a case, it is preferable, for example, from the viewpoint of energy efficiency that the heating be performed at a lower temperature.

As described above, use of the relationship information on change in the glossiness of the toner image with respect to the surface temperature of the toner image enables accurate determination about the surface temperature of the toner image for the glossiness specified by the user and more precise adjustment of the glossiness.

It is preferable that the surface temperature of the toner image when the glossiness of the toner image is reduced be equal to or lower than the softening temperature of the toner constituting the toner image. This can efficiently recover elasticity of the toner constituting the toner image without melting the toner and reduce the glossiness of the toner image.

Further, it is preferable that the surface temperature of the toner image when the glossiness of the toner image is reduced or increased be in a range of −30° C. to +100° C., inclusive, of the softening temperature of the toner constituting the toner image. The surface temperature being equal to or higher than −30° C. of the softening temperature can efficiently soften the toner and make it easy to change the glossiness, whereas the surface temperature being equal to or lower than +100° C. of the softening temperature can suppress excessive melt of the toner and make it hard to generate image unevenness of the toner image.

The softening temperature of the toner can be measured, for example, with a flow tester as described below.

The measurement procedure of the softening temperature is as follows: place and flatten out 1.1 g of the toner in a Schale (petri dish) under the environment of a temperature of 20±1° C. and a relative humidity of 50±5%; leave the toner for 12 hours or more; apply a pressure of $3.75\times10^8$ Pa (3,820 kg/cm$^2$) to the toner for 30 seconds with a molding machine SSP-A (manufactured by Shimadzu Corporation), thereby producing a cylindrical molded sample having a diameter of 1 cm.

The measurement procedure of the softening temperature continues as follows: set the molded sample in a flow tester CFT-500D (manufactured by Shimadzu Corporation) under the environment of a temperature of 24±5° C. and a relative humidity of 50±20%; after preheating, extrude the molded sample from a hole (1 mm×1 mm) of a cylindrical die with a piston having a diameter of 1 cm with conditions of an applied load of 196 N (20 kgf), an initial temperature of 60° C., a preheating time of 300 seconds and a temperature rising rate of 6° C. per minute; and take, as the softening temperature of the toner, an offset method temperature T (offset) measured by a method of measuring a melting point while increasing temperature, setting an offset value at 5 mm.

It is preferable to have, before the glossiness control step, a step of detecting the glossiness of the toner image fixed to the recording medium. This can inform the user about the glossiness of the toner image in advance, which can adjust the glossiness more accurately.

In general, however, if toner images are fixed under the same condition(s) by the same apparatus, the toner images have the same glossiness, and hence if the glossiness of a toner image is detected in advance, the glossiness of another toner image is not always needed to be detected.

As described above, examples of the non-contact heating device include (i) the device for heating by infrared rays with a heater or the like, (ii) the device for heating with a heating plate, (iii) the device for heating by light emission, and (iv) the device for heating by hot air blowing. Hereinafter, with respect to (i) to (iii), examples of configuration for the glossiness control will be described. With respect to (iv), namely, the device for heating by light emission, the configuration is basically the same as that described in "(i) Device for Heating by Infrared Rays with Heater or the like" below except that a hot air blower is used instead of a heater 101A. Hence, detailed description thereof will be omitted.

(i) Device for Heating by Infrared Rays with Heater or the Like

Figure 5:
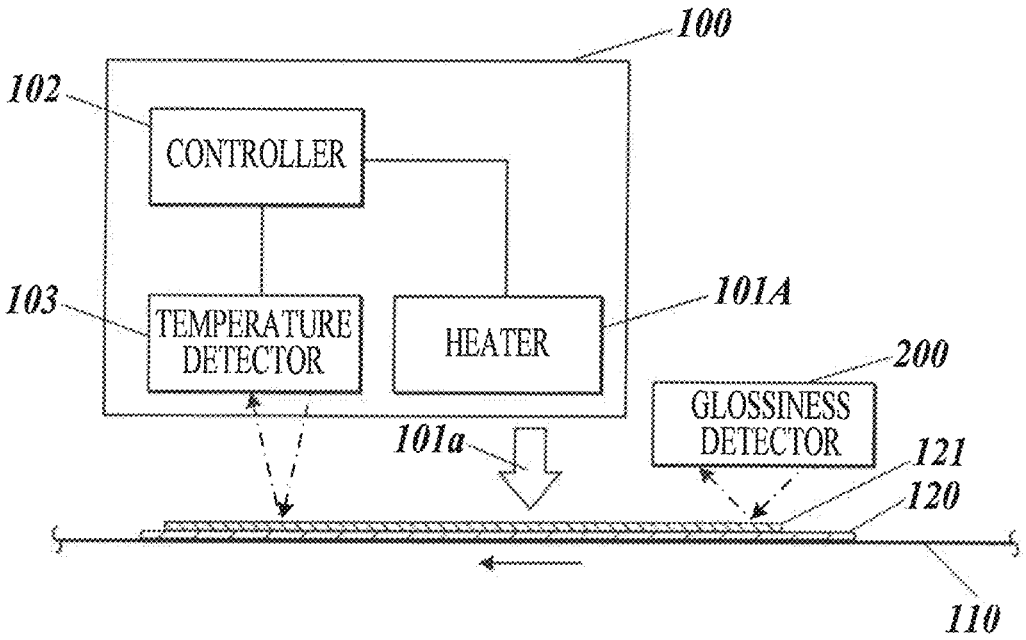
FIG. 5 is a schematic view showing an example of a glossiness detector and a glossiness control unit.

The glossiness control step is performed, for example, by a glossiness control unit 100 including the heater 101A as the non-contact heating device, a controller 102 (hardware processor) and a temperature detector 103 (shown in FIG. 5). Hereinafter, as the heater 101A, an IR heater is used.

The heater 101A emits infrared rays to a toner image 121 when a recording medium 120 to which the toner image 121 is fixed is moved to the glossiness control unit 100 by a conveyor belt 110.

The controller 102 instructs the heater 101A on conditions including intensity of infrared rays to emit and an irradiation position with the infrared rays, and causes the heater 101A to emit the infrared rays.

The temperature detector 103 detects the surface temperature of the heated toner image 121, and informs the controller 102 about the temperature information. If the toner image surface temperature is selected in advance for the glossiness specified by the user, the temperature detector 103 may inform the controller 102 about whether or not the surface temperature of the toner image 121 is the selected temperature.

Hereinafter, other examples of the non-contact heating device will be described. To the components having the same functions as the above are given the same names and reference numbers, and descriptions thereof will be partly omitted.

(ii) Device for Heating with Heating Plate

Figure 6:
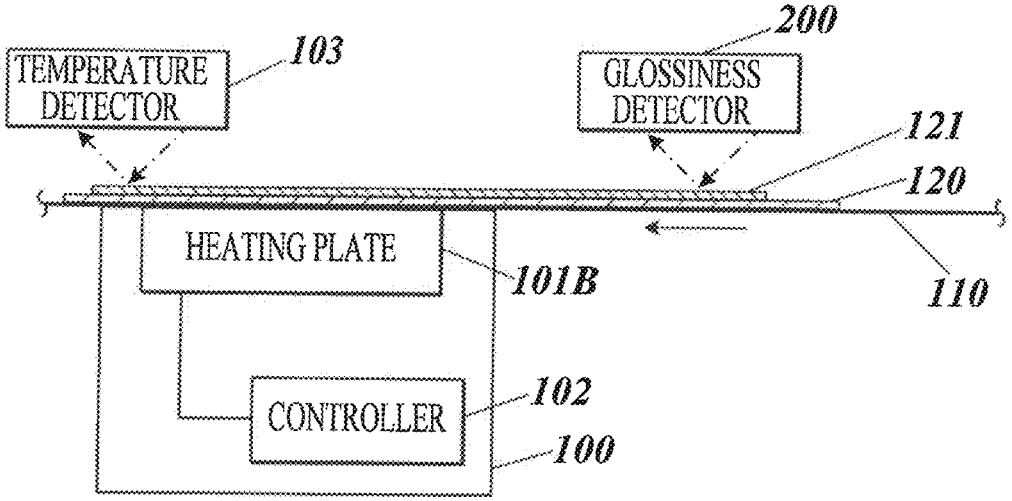
FIG. 6 is a schematic view showing another example of the glossiness detector and the glossiness control unit.

The glossiness control step is performed, for example, by a glossiness control unit 100 including a heating plate 101B as the non-contact heating device, a controller 102 and a temperature detector 103 (shown in FIG. 6).

The heating plate 101B heats a toner image 121 via a recording medium 120 from a side of the recording medium 120, the side where the toner image 121 is not formed, when the recording medium 120 to which the toner image 121 is fixed is moved to the glossiness control unit 100 by a conveyor belt 110.

The controller 102 instructs the heating plate 101B on conditions including a heating temperature and a heating position, and causes the heating plate 101B to heat up (i.e. generate the heat).

The temperature detector 103 detects the surface temperature of the heated toner image 121, and informs the controller 102 about the temperature information.

The temperature detector 103 detects, in order to detect the surface temperature of the heated toner image 121, the surface temperature of the toner image 121 from a side of the recording medium 120, the side where the toner image 121 is formed. In FIG. 6, for purposes of illustration, the temperature detector 103 is shown outside the glossiness control unit 100, but the temperature detector 103 is one of the components of the glossiness control unit 100.

(iii) Device for Heating by Light Emission

To heat a toner image by light emission, a toner image formed of toner containing a light absorbing compound needs to be fixed to a recording medium. Hence, in the glossiness control step, light which is absorbed by the compound contained in the toner is emitted to the toner image fixed to the recording medium, thereby heating the toner image.

Figure 7:
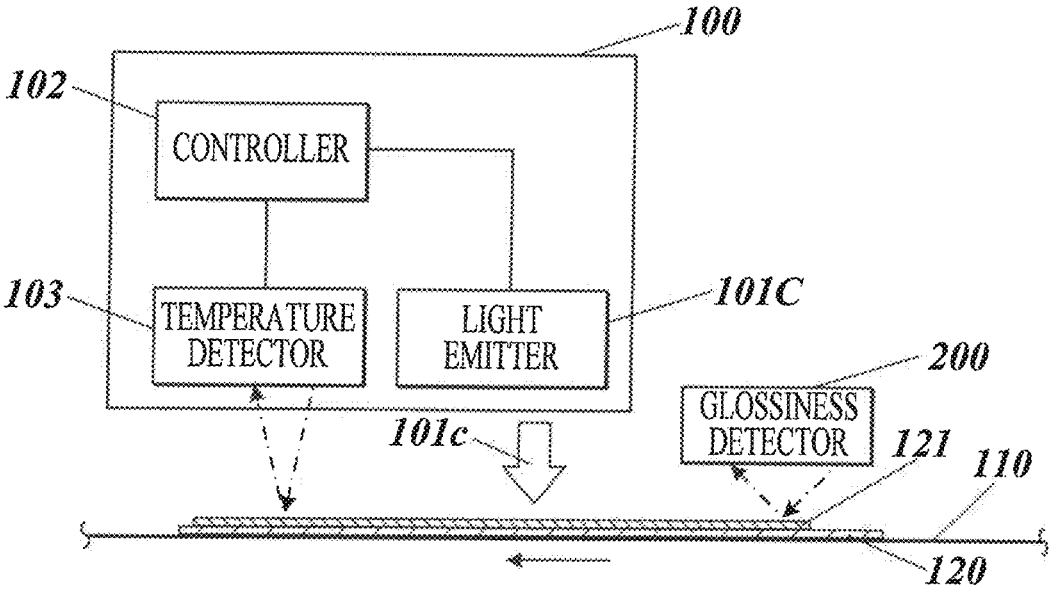
FIG. 7 is a schematic view showing another example of the glossiness detector and the glossiness control unit.

The glossiness control step is performed, for example, by a glossiness control unit 100 including a light emitter 101C as the non-contact heating device, a controller 102 and a temperature detector 103 (shown in FIG. 7).

The light emitter 101C emits light for controlling the glossiness (hereinafter "glossiness control light") 101*c* to a toner image 121 when a recording medium 120 to which the toner image 121 is fixed is moved to the glossiness control unit 100 by a conveyor belt 110.

The controller 102 instructs the light emitter 101C on conditions including the amount of light to emit and an irradiation position with the light, and causes the light emitter 101C to emit the glossiness control light 101*c*.

The temperature detector 103 detects the surface temperature of the heated toner image 121, and informs the controller 102 about the temperature information.

It is preferable that the light absorbing compound be a compound which absorbs light in a wavelength range of 280 nm to 850 nm. Further, it is preferable that the glossiness control light be light having the maximum emission wavelength in the wavelength range of 280 nm to 850 nm. In order to reduce or increase the glossiness of the toner image, it is necessary to efficiently re-melt (or re-soften) the toner. Then, the compound (e.g. a colorant, an UV absorber, etc.) which absorbs light in the wavelength range of 280 nm to 850 nm, has large excitation energy, and is contained in the toner is irradiated with the light having the maximum emission wavelength in the wavelength range in which the compound absorbs light. This makes it easy to control the glossiness of the toner image.

From the viewpoint that the efficient re-melt of the toner makes it easy to adjust the glossiness of the toner, it is preferable that the maximum absorption wavelength of the light absorbing compound contained in the toner and the emission wavelength of the glossiness control light coincide.

The glossiness control light may be any light as far as it can at least reduce the glossiness of the toner image. That is, it may be light which can only reduce the glossiness, or light which can both reduce and increase the glossiness. From the viewpoint of widening the glossiness controllable range, it is preferable that the glossiness control light be light which can both reduce and increase the glossiness.

It is preferable, in the glossiness control step, to adjust the light amount of the glossiness control light on the basis of the glossiness information specified by the user. This can emit the glossiness control light to the toner image with the light amount for the glossiness specified by the user.

The light amount of the glossiness control light is adjusted, as shown in FIG. 4, such that the toner image surface temperature becomes the toner image surface temperature for the desired glossiness.

The light amount of the glossiness control light may be adjusted on the basis of relationship information on change in the glossiness (%) of the toner image with respect to the light amount (J/cm$^2$) of the glossiness control light to be emitted. This can more precisely adjust the light amount for the glossiness specified by the user.

Herein, the "light amount" means the total amount of light to be emitted. The emitting time is not particularly limited, but preferably short to achieve the desired glossiness. The short emitting time can increase a conveyance speed and reduce an irradiation width, and hence preferable from the viewpoint of increasing an image processing speed and saving the space of the apparatus too.

Figure 8:
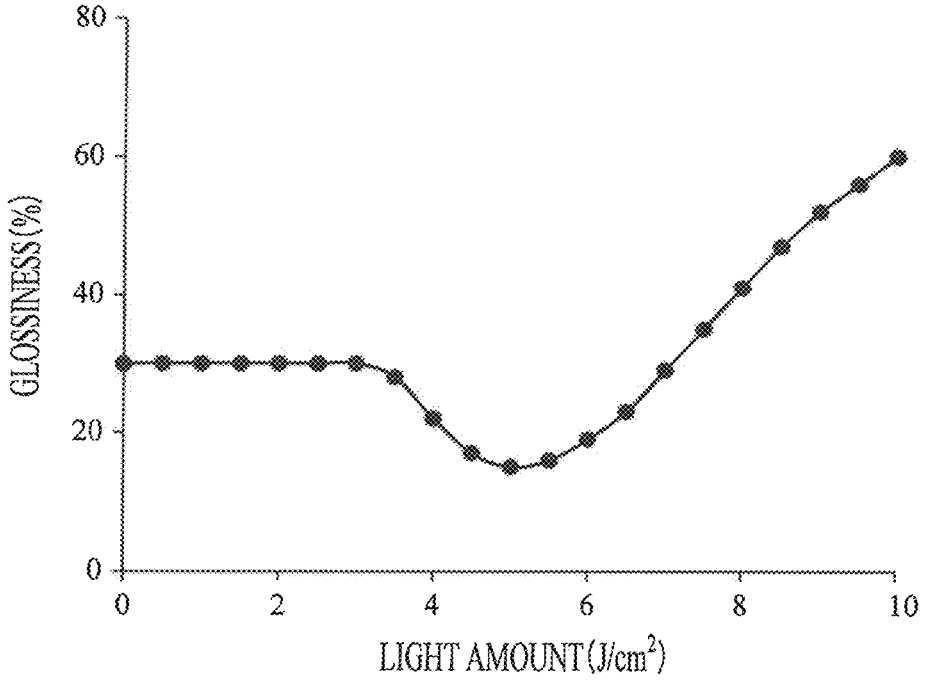
FIG. 8 is a graph showing change in glossiness (%) of a toner image with respect to light amount (J/cm$^2$) of glossiness control light.

The relationship information on change in the glossiness (%) of the toner image with respect to the light amount (J/cm$^2$) of the glossiness control light is, for example, a graph as shown in FIG. 8. The graph shows change in the glossiness (%) of a certain toner image(s) fixed to a recording medium (media) with respect to the light amount (J/cm$^2$) of predetermined glossiness control light when the toner image is irradiated with the glossiness control light. The graph shown in FIG. 8 shows not actual measured values but typical values schematically, and numerical values on the horizontal axis and the vertical axis are for purposes of illustration.

The graph shown in FIG. 8 may be created, for example, as follows: emit glossiness control light having a predetermined maximum emission wavelength (e.g. 365 nm) with an arbitrary light amount to a toner image (solid image) fixed to a recording medium; and plot the glossiness with respect to the emitted light amount. The glossiness can be obtained by, with a gloss meter (Multi Gloss 268Plus manufactured by Konica Minolta, Inc.), measuring the glossiness (%) at an incident angle of 60° at five points in total on the toner image irradiated with the glossiness control light, and calculating the average value of the five points as the glossiness (%). The five points are: the center point of the image; and two points in each of the up and down directions of the long axis direction at 50 mm intervals from the center point of the image.

In order to adjust the glossiness more accurately, it is preferable to have, before the glossiness control step, a step of detecting the glossiness of the toner image fixed to the recording medium. If, for the fixed toner image, change in the glossiness (%) of the toner image with respect to the light amount (J/cm$^2$) of predetermined glossiness control light when the toner image is irradiated with the glossiness control light as shown in FIG. 8 is obtained in advance, when the user specifies a numerical value of the glossiness (%), the light amount for the numerical value is emitted. That is, the glossiness control light can be emitted for the glossiness specified by the user.

There may be two or more light amounts to be emitted to change the current glossiness of the toner image to the specified glossiness. For example, in the case shown in FIG. 8, in order to reduce the glossiness to 20%, about 4.0 J/cm$^2$ of light or about 6.5 J/cm$^2$ of light may be emitted to the toner image. In such a case, it is preferable, for example, from the viewpoint of irradiation efficiency that weaker light, namely, a smaller amount (about 4.0 J/cm$^2$) of light be emitted.

In the glossiness control step, the irradiation position with the glossiness control light can be set on the basis of toner image position information specified by the user.

In the case where the device for heating by infrared rays with a heater or the like or the device for heating with a heating plate is used, the heating position can be adjusted on the basis of the position information specified by the user. However, in the case where the device for heating by light emission is used, more precise adjustment can be performed. Hence, hereinafter, a representative example of the case where the device for heating by light emission is used will be described.

The image post-processing method of the present invention can heat only a portion of a toner image(s) at a position specified by the user, and hence can reduce or increase the glossiness of only the portion of the toner image at the specified position.

The "toner image position information specified by the user" in the present invention indicates a position (or portion) of/on a toner image fixed to a recording medium, the position being specified by the user to reduce or increase the glossiness. Here, the toner image position information on a position of/on a toner image, the position at which the glossiness is desired to be reduced or increased, may be selected/specified by any method as far as the method can select/specify the position. For example, the user may specify the position in advance with an input screen or the like, or the fixed toner image(s) may be displayed on a display and the user may specify the position while checking the toner image(s) displayed on the display. Then, the controller 102 causes the light emitter 101C to emit the glossiness control light 101*c* on the basis of the position information. This can reduce or increase the glossiness of only a portion of the toner image(s), the portion being at the specific position specified by the user.

Further, because light emission to the specified position can adjust the glossiness of the fixed toner image at the specified position, an image post-processing apparatus or an image forming apparatus which can perform the image post-processing method of the present invention can also be used as a marking apparatus.

Examples of a light source used in the light emitter 101C include a light emitting diode (LED) and a laser light source. One or more light sources may be installed.

The maximum emission wavelength of the glossiness control light is preferably in the wavelength range of 280 to 850 nm. The maximum emission wavelength being shorter than 280 nm causes bond cleavage of the compound and thereby lowers color reproducibility, whereas the maximum emission wavelength being longer than 850 nm makes it difficult to obtain enough energy and thereby makes it difficult to provide enough energy to change the glossiness.

The maximum emission wavelength of the glossiness control light is further preferably in a wavelength range of 280 to 500 nm, wherein 500 nm is exclusive. The maximum emission wavelength being in this wavelength range can produce enough energy to change the glossiness. This can eliminate a need to change the light source depending on the type of the colorant used in the toner, and can save the space of an apparatus which performs image post-processing.

The light amount of the glossiness control light to be emitted should be controlled within a range in which the effects of the present invention can be obtained by the content of the light absorbing compound contained in the toner. The light amount is controlled preferably within a range of 0.01 to 100 J/cm$^2$ and further preferably within a range of 0.01 to 50 J/cm$^2$.

[Image Forming Method]

An image forming method of the present invention includes the glossiness control step described above. The glossiness control is performed on toner images fixed to recording media. The fixing step of fixing toner images to recording media according to the present invention can be performed on toner images transferred onto recording media in a transferring step via a charging step, an exposing step and a developing step of a known electrophotographic image forming method.

Hereinafter, these steps and a cleaning step which is performed after these steps will be described.

<Charging Step>

In this step, an electrophotographic photoreceptor is charged. The charging method is not particularly limited, and examples thereof include a charging method which uses a contact or non-contact roller(s).

<Exposing Step>

In this step, an electrostatic latent image is formed on the electrophotographic photoreceptor (an electrostatic latent image holding member).

The electrophotographic photoreceptor is not particularly limited, and examples thereof include a known drum-shaped organic photoreceptor.

The electrostatic latent image is formed, as described below, by charging the surface of the electrophotographic photoreceptor uniformly with a charger and exposing the surface of the electrophotographic photoreceptor imagewise with an exposure unit.

The exposure unit is not particularly limited, and examples thereof include an exposure unit constituted of LEDs of light emitting elements arrayed in the axial direction of the electrophotographic photoreceptor and imaging elements, and a laser optical system.

<Developing Step>

In this step, the electrostatic latent image is developed by a dry developer containing toner, so that a toner image is formed.

The toner image is formed by containing the dry developer containing the toner, for example, by a developing sleeve which has a built-in magnet and rotates while holding the developer and a voltage applier which applies direct and/or alternating current bias voltages to between the developing sleeve and the photoreceptor. More specifically, the toner and carrier are mixed and stirred, and the toner is charged by friction at the time and held on the surface of a rotating magnetic roller to form a magnetic brush. Because the magnetic roller is arranged near the electrophotographic photoreceptor, a part of the toner constituting the magnetic brush formed on the surface of the magnetic roller is transferred onto the surface of the electrophotographic photoreceptor by electrical attraction force. As a result, the electrostatic latent image is developed with the toner, so that the toner image is formed on the surface of the electrophotographic photoreceptor.

<Transferring Step>

In this step, the toner image is transferred onto a recording medium.

The toner image is transferred onto the recording medium by separation charging of the toner image to the recording medium.

Examples usable as the transfer unit include a corona transfer device with corona discharge, a transfer belt, and a transfer roller.

In the transferring step, for example, an intermediate transfer member may be used, and the toner image may be primary-transferred onto the intermediate transfer member and thereafter secondary-transferred onto the recording medium, or the toner image formed on the electrophotographic photoreceptor may be directly transferred onto the recording medium.

The recording medium is not particularly limited, and examples thereof include thin to thick plain paper, high quality paper, coated printing paper such as art paper and coated paper, commercially available Japanese paper and postcard paper, plastic films for OHP, and cloth.

<Fixing Step>

In this step, the toner image transferred onto the recording medium is fixed to the recording medium. More specifically, a unit employing a fixing-by-rollers system is used. This unit includes: a fixing roller; and a pressure roller arranged so as to form a fixing nip part by press-contacting the fixing roller.

<Cleaning Step>

After the above steps, a cleaning step of removing the residual toner on the electrophotographic photoreceptors is performed.

In this step, a liquid developer which remains on developer holding members such as a developing roller(s), the photoreceptor and/or the intermediate transfer member by not being used in image forming or not being transferred is removed from the developer holding members.

The cleaning method is not particularly limited, but preferably a method using a blade which is arranged such that its tip abuts the photoreceptor and scrapes the surface of the photoreceptor. For example, a cleaner constituted of a cleaning blade and a brush roller arranged on the upstream side of the cleaning blade can be used.

[Image Forming Apparatus]

An image forming apparatus of the present invention is an image forming apparatus which forms electrophotographic images, and includes: a transfer unit which transfers, onto a recording medium (media), a toner image(s) formed in a developing unit; a fixing unit which fixes the toner image to the recording medium; and a glossiness control unit which, with a non-contact heating device configured to heat a toner image(s) fixed to a recording medium (media) to the temperature which reduces glossiness of the toner image, heats the toner image fixed to the recording medium so as to reduce glossiness of the toner image.

Hereinafter, an example of the image forming apparatus applicable to the present invention will be described with reference to the drawings.

Figure 9:
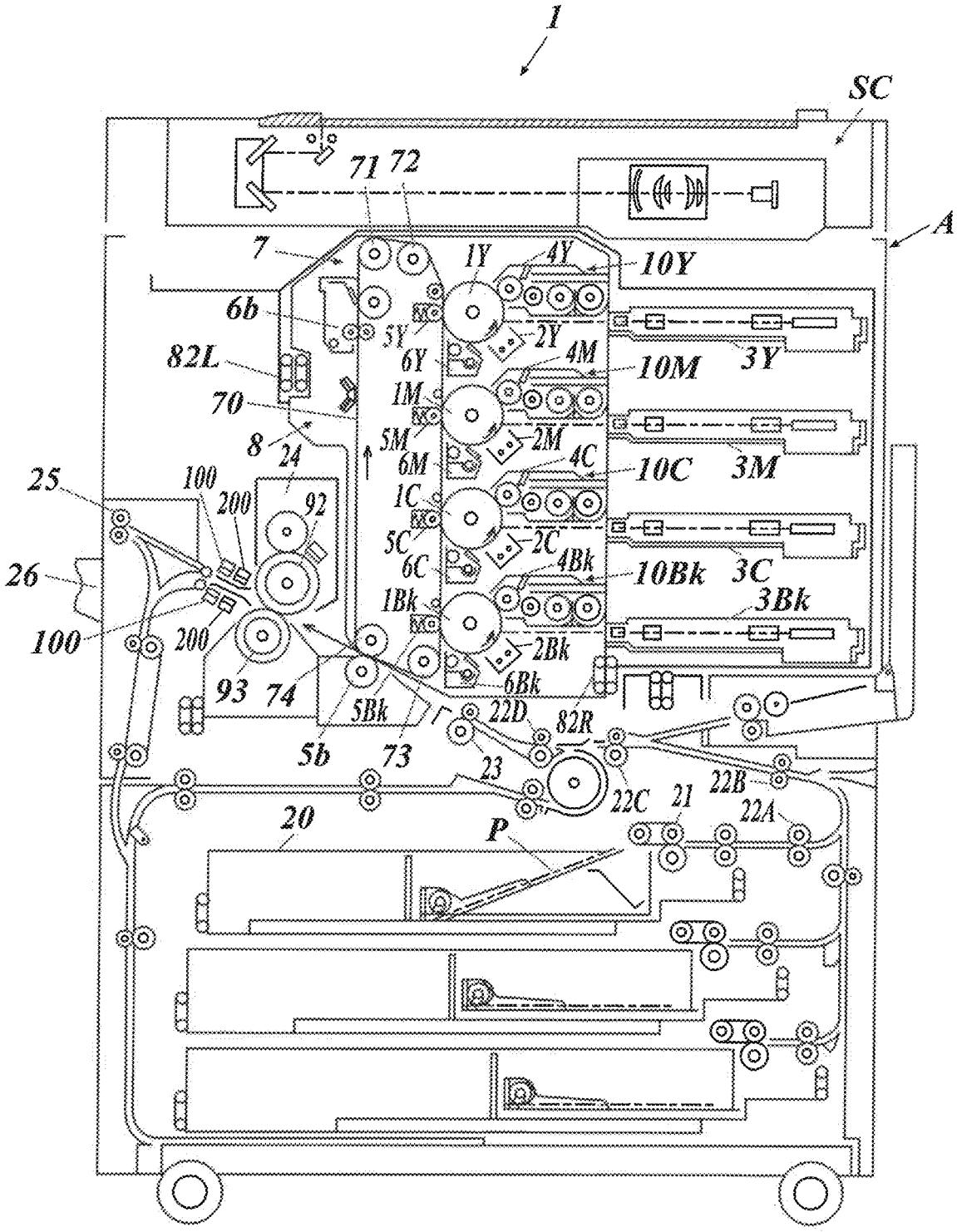
FIG. 9 is a schematic view showing schematic configuration of an image forming apparatus of the present invention as an example.

An image forming apparatus 1 shown in FIG. 9 is called tandem color image forming apparatus, and includes: four image forming units (process cartridges) 10Y, 10M, 10C, 10Bk; an endless-belt-shaped intermediate transfer member unit 7; a sheet feeder 21; and a fixing unit 24 as the fixing unit. On the upper side of a main body A of the image forming apparatus 1, a document image scanner SC is arranged.

Although FIG. 9 shows the image forming apparatus 1 having the four image forming units (process cartridges) 10Y, 10M, 10C, 10Bk, it may have only the image forming unit Bk, or at least two image forming units among the four image forming units (process cartridges) 10Y, 10M, 10C, 10Bk.

The image forming unit 10Y forms yellow images. The image forming unit 10Y includes: a drum-shaped electrophotographic photoreceptor 1Y; and a charger 2Y, an exposure unit 3Y, a developing unit 4Y as the developing unit and a cleaner 6Y which are arranged around the electrophotographic photoreceptor 1Y, and is provided with a primary transfer roller 5Y as the transfer unit.

The image forming unit 10M forms magenta images. The image forming unit 10M includes: a drum-shaped electrophotographic photoreceptor 1M; and a charger 2M, an exposure unit 3M, a developing unit 4M as the developing unit and a cleaner 6M which are arranged around the electrophotographic photoreceptor 1M, and is provided with a primary transfer roller 5M as the transfer unit.

The image forming unit 10C forms cyan images. The image forming unit 10C includes: a drum-shaped electrophotographic photoreceptor 1C; and a charger 2C, an exposure unit 3C, a developing unit 4C as the developing unit and a cleaner 6C which are arranged around the electrophotographic photoreceptor 1C, and is provided with a primary transfer roller 5C as the transfer unit.

The image forming unit 10Bk forms black images. The image forming unit 10Bk includes: a drum-shaped electrophotographic photoreceptor 1Bk; and a charger 2Bk, an exposure unit 3Bk, a developing unit 4Bk as the developing unit and a cleaner 6Bk which are arranged around the electrophotographic photoreceptor 1Bk, and is provided with a primary transfer roller 5Bk as the transfer unit.

The image forming units 10Y, 10M, 10C, 10Bk have the same configuration except the colors of the toner images formed on the electrophotographic photoreceptors 1Y, 1M, 1C, 1Bk. Hence, hereinafter the image forming unit 10Y will be described as an example.

In the embodiment(s), in the image forming unit 10Y, at least the electrophotographic photoreceptor 1Y, the charger 2Y, the developing unit 4Y and the cleaner 6Y are integrated.

The charger 2Y uniformly provides electric charge to the electrophotographic photoreceptor 1Y, thereby charging (e.g. negatively charging) the surface of the electrophotographic photoreceptor 1Y (e.g. the surface of a protective layer of the electrophotographic photoreceptor 1Y). The charger 2Y may charge the surface of the electrophotographic photoreceptor 1Y by a non-contact charging method, but preferably by a contact charging method as described below.

The exposure unit 3Y exposes the surface of the electrophotographic photoreceptor 1Y (e.g. the surface of the protective layer of the electrophotographic photoreceptor 1Y), which has been uniformly provided with the electric potential by the charger 2Y, on the basis of an image signal(s) (yellow), thereby forming an electrostatic latent image of a yellow image. Examples usable as the exposure unit 3Y include a unit constituted of LEDs of light emitting elements arrayed in the axial direction of the electrophotographic photoreceptor 1Y and imaging elements (product name SELFOC® lens (array)), and a laser optical system.

The developing unit 4Y develops the electrostatic latent image formed by the exposure unit 3Y with an electrostatic latent image developer, thereby forming a toner image. The electrostatic latent image developer to be used is not particularly limited, but preferably a dry developer.

In the image forming apparatus 1 of the embodiment(s), it is possible that the electrophotographic photoreceptor 1Y, the charger 2Y, the exposure unit 3Y, the developing unit 4Y and the cleaner 6Y are integrated as a process cartridge, and this process cartridge is detachably attached to the main body A. Alternatively, it is possible that at least one of the charger 2Y, the exposure unit 3Y, the developing unit 4Y, a transfer or releasing unit and the cleaner 6Y is integrated with and supported by the electrophotographic photoreceptor 1Y to constitute a process cartridge, this process cartridge is configured as a single image forming unit which can be detachably attached to the main body A, and this single image forming unit is detachably attached to the main body A by using a guiding device such as a rail(s) of the main body A.

A housing 8 houses the image forming units 10Y, 10M, 10C, 10Bk and the endless-belt-shaped intermediate transfer member unit 7. The housing 8 is configured to be drawn from the main body A along supporting rails 82L, 82R. In the housing 8, the image forming units 10Y, 10M, 10C, 10Bk are arranged tandem in the vertical direction. The endless-belt-shaped intermediate transfer member unit 7 is arranged on the left side of the electrophotographic photoreceptors 1Y, 1M, 1C, 1Bk in FIG. 9, and includes: a rotatable endless-belt-shaped intermediate transfer member 70 wound around rollers 71, 72, 73, 74; the primary transfer rollers 5Y, 5M, 5C, 5Bk; and a cleaner 6*b*.

The fixing unit 24 has a pressure applying unit which presses the toner image(s) formed on a recording medium P.

The pressure applying unit includes a fixing roller 92 and a pressure roller 93. When the recording medium P having the toner image is fed, the fixing roller 92 and the pressure roller 93 press and make the toner image adhere to the recording medium P.

The fixing roller 92 can heat the toner image on the recording medium P when the recording medium P passes through between the fixing roller 92 and the pressure roller 93. The toner image softened by irradiation is further softened by this heating. As a result, fixability of the toner image to the recording medium P is further improved. The heating temperature of the fixing roller 92 is preferably in a range of 30 to 100° C. and further preferably in a range of 40 to 100° C.

The glossiness control unit 100 as the glossiness control unit has the non-contact heating device, the controller 102 and so forth. The glossiness control unit 100 has been described above with reference to FIG. 5 to FIG. 7. Hence, its description will not be repeated here.

It is preferable to arrange, between the fixing unit 24 and the glossiness control unit 100, a glossiness detector 200 which detects the glossiness. This can detect (measure) the glossiness of the toner image before irradiated with the glossiness control light (heated). Hence, the user can first check a numerical value of the measured glossiness, and then decide whether to reduce or increase the glossiness from the detected glossiness in the glossiness control unit 100, for example.

It is also preferable to arrange the glossiness detector 200 on the downstream side of the glossiness control unit 100. This allows the user to check whether or not the glossiness has been adjusted to the desired glossiness in the glossiness control unit 100. Also, the glossiness control unit 100 may adjust the glossiness again after the glossiness detector 200 detects the glossiness.

Hereinafter, an image forming method using the image forming apparatus 1 shown in FIG. 9 will be described.

The images formed by the image forming units 10Y, 10M, 10C, 10Bk, respectively, are sequentially transferred onto the rotating endless-belt-shaped intermediate transfer member 70 by the primary transfer rollers 5Y, 5M, 5C, 5Bk, thereby forming a combined color image.

A recording medium P accommodated in a sheet feeding cassette 20 is fed by the sheet feeder 21 and conveyed to a secondary transfer roller 5*b* as the transfer unit via multiple intermediate rollers 22A, 22B, 22C, 22D and registration rollers 23. The combined color image is secondary-transferred onto the recording medium P by the secondary transfer roller 5*b*. That is, the Y, M, C, Bk images are transferred onto the recording medium P collectively. When the combined color image is secondary-transferred onto the recording medium P, the endless-belt-shaped intermediate transfer member 70 self-strips the recording medium P.

In the fixing unit 24, the toner image (i.e. the combined color image) is fixed to the recording medium P by the fixing roller 92 and the pressure roller 93.

Next, in the glossiness control unit 100, the toner image fixed to the recording medium P is heated such that the glossiness is reduced or increased.

The image-post-processed recording medium P is pinched by sheet ejecting rollers 25 and placed on a sheet receiving tray 26 provided outside of the apparatus. The electrostatic latent image developer (residual toner) adhering to the intermediate transfer member 70 is removed by the cleaner 6*b*.

During image forming, the primary transfer roller 5Bk always abuts the surface of the electrophotographic photoreceptor 1Bk. Meanwhile, the primary transfer rollers 5Y, 5M, 5C abut the surfaces of their corresponding electrophotographic photoreceptors 1Y, 1M, 1C only during color image forming. The secondary transfer roller 5*b* abuts the surface of the endless-belt-shaped intermediate transfer member 70 only at the time of secondary transfer, namely, at the time when recording media P pass the secondary transfer roller 5*b*.

[Image Post-Processing Apparatus and Image Forming Apparatus to which Image Post-Processing Apparatus is Attached]

The image post-processing apparatus of the present invention is an image post-processing apparatus for adjusting glossiness of fixed toner images, and includes the glossiness control unit which, with the non-contact heating device configured to heat toner images fixed to recording media to the temperature which reduces the glossiness of the toner images, heats toner images fixed to recording media so as to reduce the glossiness of the toner images.

That is, the image post-processing apparatus of the present invention is an image post-processing apparatus including the glossiness control unit 100 (shown in FIG. 5 to FIG. 7) described above. It is preferable that this image post-processing apparatus be detachably attached to an electrophotographic image forming apparatus, for example.

Further, an image forming apparatus which forms electrophotographic images, including: a transfer unit which transfers, onto a recording medium (media), a toner image(s) formed in a developing unit; and a fixing unit which fixes the toner image to the recording medium, wherein the image post-processing apparatus of the present invention is attached to this image forming apparatus is also included in the scope of the present invention.

[Toner (Toner for Developing Electrostatic Latent Image)]

Hereinafter, toner (toner for developing electrostatic latent images) preferably used in the case where the device for heating by light emission is used as the non-contact heating device will be described.

Although the toner described below can also be used in the cases where other examples of the non-contact heating device are used, toner used in these cases does not need to contain the light absorbing compound described below.

In the image post-processing method of the present invention, if the device for heating by light emission is used as the non-contact heating device, toner containing the light absorbing compound (toner for developing electrostatic latent images) is used.

It is preferable that the toner according to the present invention be an assembly of toner base particles or toner particles.

Herein, the toner particles are the toner base particles with an external additive added. The toner base particles may be used as the toner particles as they are.

<Light Absorbing Compound>

The light absorbing compound contained in the toner is preferably a compound which absorbs light in the wavelength range of 280 nm to 850 nm.

In the present invention, the "compound which absorbs light in the wavelength range of 280 nm to 850 nm" is a compound having an absorbance of 0.01 or more at an arbitrary wavelength in the wavelength range of 280 nm to 850 nm, wherein the absorbance is obtained by dissolving the compound in a solvent (e.g. DMF, THF, chloroform, etc.) at a concentration of 0.01 mass % and measuring the absorbance with a spectrophotometer.

Preferable examples of the compound which absorbs light in the wavelength range of 280 nm to 850 nm contained in the toner used in the present invention include colorants of black, yellow, magenta and cyan, and an UV absorber. The toner used in the present invention may contain one kind of the compound which absorbs light in the wavelength range of 280 nm to 850 nm, or may contain two or more kinds thereof.

<Colorant>

Preferably, the toner particles according to the present invention contain a colorant as the above light absorbing compound. Usable examples of the colorant include generally known dyes and pigments.

Examples of the colorant to obtain a black toner include carbon black, a magnetic material, and iron-titanium complex oxide black.

Examples of the carbon black include channel black, furnace black, acetylene black, thermal black, and lamp black. Examples of the magnetic material include ferrite and magnetite.

Examples of the colorant to obtain a yellow toner include: dyes such as C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, and C.I. Solvent Yellow 162; and pigments such as C.I. Pigment Yellow 14, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180, and C.I. Pigment Yellow 185.

Examples of the colorant to obtain a magenta toner include: dyes such as C.I. Solvent Red 1, C.I. Solvent Red 49, C.I. Solvent Red 52, C.I. Solvent Red 58, C.I. Solvent Red 63, C.I. Solvent Red 111, and C.I. Solvent Red 122; and pigments such as C.I. Pigment Red 5, C.I. Pigment Red 48:1, C.I. Pigment Red 53:1, C.I. Pigment Red 57:1, C.I. Pigment Red 122, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Examples of the colorant to obtain a cyan toner include: dyes such as C.I. Solvent Blue 25, C.I. Solvent Blue 36, C.I. Solvent Blue 60, C.I. Solvent Blue 70, C.I. Solvent Blue 93, and C.I. Solvent Blue 95; and pigments such as C.I. Pigment Blue 1, C.I. Pigment Blue 7, C.I. Pigment Blue 15, C.I. Pigment Blue 15:3, C.I. Pigment Blue 60, C.I. Pigment Blue 62, C.I. Pigment Blue 66, and C.I. Pigment Blue 76.

As the colorant to obtain each color, for each color, one kind of the colorant or two or more kinds thereof combined can be used.

The content ratio of the colorant to the total mass (100 mass %) of the toner particles is preferably in a range of 1 to 30 mass % and further preferably in a range of 2 to 20 mass %. If the content ratio is 1 mass % or more, sufficient coloring power can be obtained, whereas if the content ratio is 30 mass % or less, high quality images can be obtained because the colorant does not separate from the toner to adhere to the carrier, and chargeability of the toner becomes stable.

<UV (Ultraviolet) Absorber>

The toner particles according to the present invention preferably contain the UV absorber as the above light absorbing compound.

The UV absorber in the present invention is an additive which has an absorbance wavelength in a wavelength range of 180 to 400 nm, and is deactivated from an excited state by non-radiative deactivation without structure change such as isomerization or bond cleavage, at least under the environment where the temperature is 0° C. or more. The UV absorber may be an organic compound or an inorganic compound as far as it satisfies the above conditions, and other than a common organic UV absorber, additives such as a light stabilizer and antioxidant are in the scope of the UV absorber in the present invention.

Further, UV absorbing polymer having a polymer chain including functional groups having an organic UV absorber skeleton can also be used.

It is preferable that the UV absorber have the maximum absorption wavelength in a range of 180 to 400 nm. Further, an organic UV absorber is preferred to an inorganic UV absorber.

Examples of the organic UV absorber usable in the present invention include known organic UV absorbers such as a benzophenone UV absorber, a benzotriazole UV absorber, a triazine UV absorber, a cyanoacrylate UV absorber, a salicylate UV absorber, a benzoate UV absorber, a diphenylacrylate UV absorber, a benzoic acid UV absorber, a salicylic acid UV absorber, a cinnamic acid UV absorber, a dibenzoylmethane UV absorber, a β,β-diphenylacrylate UV absorber, a benzylidene camphor UV absorber, a phenyl benzimidazole UV absorber, an anthranil UV absorber, an imidazoline UV absorber, a benzalmalonate UV absorber, and a 4,4-diaryl butadiene UV absorber. Among these, a benzophenone UV absorber, a benzotriazole UV absorber, a triazine UV absorber, a cyanoacrylate UV absorber, and a dibenzoylmethane UV absorber are preferable.

The above may be used alone or in combinations of two or more kinds.

Examples of the benzophenone UV absorber (UV absorber containing a benzophenone compound) include octabenzone, 2,4-hydroxybenzophenone, 2-hydroxy-4-methoxybenzophenone, and 2-hydroxy-4-n-octyloxybenzophenone.

Examples of the benzotriazole UV absorber (UV absorber containing a benzotriazole compound) include 2-(2p-cresol, 2-(2H-benzotriazole-2-yl)-4,6-bis(1-methyl-1-phenylethyl) phenol, 2-[5-chloro(2H)-benzotriazole-2-yl]-4-methyl-6-(tert-butyl)phenol, 2-(2H-benzotriazole-2-yl)-4,6-di-tert-pentylphenol, 2-(2H-benzotriazole-2-yl)-4-(1,1,3,3-tetramethylbutyl)phenol, reaction products of methyl-3-[3-t-butyl-5-(2H-benzotriazole-2-yl)-4-hydroxyphenyl] propionate/polyethyleneglycol (molecular weight: about 300), 2-(2H-benzotriazole-2-yl)-6-dodecyl-4-methylphenol, 2-(2-hydroxy-5-tert-butylphenyl)-2H-benzotriazole, 2-ethylhexyl-3-[3-tert-butyl-4-hydroxy-5-(5-chloro-2H-benzotriazole-2-yl)phenyl]propionate, 2-(2H-benzotriazole-2-yl)-4,6-bis(1-methyl-1-phenylethyl)phenol, and 2-(2H-benzotriazole-2-yl)-6-(1-methyl-1-phenylethyl)-4-(1,1,3,3-tetramethylbutyl)phenol.

Examples of the triazine UV absorber (UV absorber containing a triazine compound) include 2-(4,6-bis(2,4-dimethylphenyl)-1,3,5-triazin-2-yl)-5-hydroxyphenyl, 2-(4,6-diphenyl-1,3,5-triazin-2-yl)-5-[(hexyl)oxy]phenol, 2-[4-[(2-hydroxy-3-dodecyloxypropyl)oxy]-2-hydroxyphenyl]-4,6-bis(2,4-dimethylphenyl)-1,3,5-triazine, 2-[4-[(2-hydroxy-3-(2'-ethyl)hexyl)oxy]-2-hydroxyphenyl]-4,6-bis(2,4-dimethylphenyl)-1,3,5-triazine, 2,4-bis(2-hydroxy-4-butyloxyphenyl)-6-(2,4-bis-butyloxyphenyl)-1,3,5-triazine, and 2-(2-hydroxy-4-[1-octyloxycarbonylothoxy]phenyl)-4,6-bis(4-phenyl)-1,3,5-triazine.

Examples of the cyanoacrylate UV absorber (UV absorber containing a cyanoacrylate compound) include ethyl2-cyano-3,3-diphenylacrylate and 2'-ethylhexyl2-cyano-3,3-diphenylacrylate.

Examples of the dibenzoylmethane UV absorber (UV absorber containing a dibenzoylmethane compound) include 4-tert-butyl-4'-methoxydibenzoylmethane (e.g. PARSOL® 1789 manufactured by DSM).

Examples of the inorganic UV absorber include titanium oxide, zinc oxide, cerium oxide, iron oxide, and barium sulfate. It is preferable that the particle diameter (size) of the inorganic UV absorber be in a range of 1 nm to 1 μm.

The content ratio of the UV absorber to the total mass (100 mass %) of the toner particles is in a range of 0.1 to 50 mass %. If the content ratio is less than 0.1 mass %, sufficient heat (energy) cannot be obtained, whereas if the content ratio is more than 50 mass %, fixed images easily peel off.

The content ratio of the UV absorber is preferably in a range of 0.5 to 35 mass %. If the content ratio is 0.5 mass % or more, obtained heat energy becomes so large that the fixability is further improved, whereas if the content ratio is 35 mass % or less, the ratio of resin becomes so large that images are strongly fixed and the fixability is further improved.

The toner particles of the present invention contain a binder resin, a releasing agent, a charge control agent and so forth, preferably with an external additive added. Hereinafter, these will be described.

<Binder Resin>

The binder resin preferably contains an amorphous resin and a crystal (crystalline) resin.

The toner particles according to the present invention contain the binder resin, so that the toner has a proper viscosity, and suppress bleeding when applied to paper. This can improve reproducibility of thin lines and reproducibility of dots.

As the binder resin, any resin generally used as a binder resin which constitutes toner particles can be used without limitation. Specific examples thereof include styrene resin, acrylic resin, styrene-acrylic resin, polyester resin, silicone resin, olefin resin, amide resin, and epoxy resin. These binder resins may be used alone or in combinations of two or more kinds.

Among these resins, because they become low viscosity when melted and have highly sharp meltability, it is preferable that the binder resin contain at least one kind selected from a group consisting of styrene resin, acrylic resin, styrene-acrylic resin and polyester resin, and far preferable that the binder resin contain at least one kind selected from a group consisting of styrene-acrylic resin and polyester resin.

A glass transition temperature (Tg) of the binder resin is preferably in a range of 35 to 70° C. and further preferably in a range of 35 to 60° C. from the viewpoint of the fixability and heat-resistant storage properties. The glass transition temperature (Tg) can be measured with differential scanning colorimetry (DSC).

It is preferable that the toner according to the present invention contain crystalline polyester resin as the crystal resin used in the binder resin from the viewpoint of improving the fixability of the toner at a low temperature (hereinafter "low-temperature fixability). From the viewpoint of further improving the low-temperature fixability of the toner, it is preferable that the toner contain, as the crystalline polyester resin, hybrid crystalline polyester resin constituted of a crystalline polyester resin segment binding with an amorphous resin segment. As the crystalline polyester resin and the hybrid crystalline polyester resin, known compounds described, for example, in JP 2017-37245 A can be used.

The toner particles containing the binder resin may have a single-layer structure or a core-shell structure. Any kind of binder resin can be used for core particles and a shell layer in the core-shell structure without particular limitation.

<Releasing Agent>

The toner particles according to the present invention may contain the releasing agent. The releasing agent to be used is not particularly limited, and various known waxes can be used.

Examples of the wax(es) include: polyolefin such as low molecular weight polypropylene, polyethylene, oxidized low molecular weight polypropylene, and oxidized polyethylene; paraffin; and synthetic ester wax.

It is preferable to use synthetic ester wax due to its low melting point/temperature and low viscosity, in particular, behenyl behenate, glycerin tribehenate, or pentaerythritol tetrabehenate.

The content ratio of the releasing agent to the total mass (100 mass %) of the toner particles is preferably in a range of 1 to 30 mass % and further preferably in a range of 3 to 15 mass %.

<Charge Control Agent>

The toner particles according to the present invention may contain the charge control agent. The charge control agent to be used is not particularly limited as far as it is a substance which is colorless and capable of positively or negatively charging the toner particles by triboelectric charging, and various known positively chargeable charge control agents and negatively chargeable charge control agents can be used.

The content ratio of the charge control agent to the total mass (100 mass %) of the toner particles is preferably in a range of 0.01 to 30 mass % and further preferably in a range of 0.1 to 10 mass %.

<External Additive>

In order to improve fluidity, chargeability, and cleanability/removability of the toner, the external additive such as a fluidizer and/or a cleaning assisting agent, which are called after-treatment agent, may be added onto the surface of the toner base particles.

Examples of the external additive include inorganic particles exemplified by: inorganic oxide particles such as silica particles, alumina particles, and titanium oxide particles; inorganic stearic acid compound particles such as aluminum stearate particles and zinc stearate particles; and inorganic titanium acid compound particles such as strontium titanate particles and zinc titanate particles.

These may be used alone or in combinations of two or more kinds.

From the viewpoint of improving the heat-resistant storage properties and environmental stability, these inorganic particles may be surface-modified by a silane coupling agent, a titanium coupling agent, a higher aliphatic acid, a silicone oil or the like.

The added amount of the external additive to the total mass (100 mass %) of the toner particles is preferably in a range of 0.05 to 5 mass % and further preferably in a range of 0.1 to 3 mass %.

<Average Particle Diameter of Toner Particles>

The toner particles have the average particle diameter preferably in a range of 4 to 10 μm and further preferably in a range of 4 to 7 μm in volume-based median diameter (D50). If the volume-based median diameter (D50) is in the abovementioned range, transfer efficiency is increased, quality of halftone images is improved, and image quality of thin lines, dots and so forth is improved.

The volume-based median diameter (D50) of the toner particles is measured and calculated with a measuring device constituted of COULTER COUNTER 3 (manufactured by Beckman Coulter Inc.) and a computer system equipped with data processing software Software V3.51 (manufactured by Beckman Coulter Inc.) connected thereto.

More specifically, the measurement and calculation are performed as follows: add and well disperse 0.02 g of a measurement sample (toner) into 20 mL of a surfactant solution (e.g. a surfactant solution of a surfactant component-containing neutral detergent diluted 10 times with pure water for dispersing toner particles) and then perform ultrasonic dispersion for one minute so as to prepare a toner particle dispersion; and pour this toner particle dispersion into a beaker containing ISOTON II (manufactured by Beckman Coulter, Inc.) in a sample stand with a pipette until the displayed concentration of the measuring device reaches 8%.

Setting this content range can generate a reproducible measurement value. The measurement and calculation are further performed as follows: set a measurement particle counting number and an aperture diameter in the measuring device at 25,000 and 50 μm, respectively; calculate frequency values with a range of 1 to 30 μm as a measurement range divided into 256 segments; and take the particle diameter at 50% in volume-based cumulative fractions from the largest as the volume-based median diameter (D50).

<Toner Producing Method>

A method for producing toner (hereinafter "toner producing method") according to the present invention can be any known method without particular limitation, but preferably an emulsion polymerization coagulation method or an emulsion coagulation method. Hereinafter, an example of the toner producing method of toner particles containing particles of an UV absorber and a colorant will be described.

The emulsion polymerization coagulation method is a method for producing toner particles, including: mixing a dispersion of particles of a binder resin (hereinafter may be referred to as "binder resin particles) produced by an emulsion polymerization method with a dispersion of particles of an UV absorber (hereinafter may be referred to as "UV absorber particles), a dispersion of particles of a colorant (hereinafter may be referred to as "colorant particles") and a dispersion of a releasing agent such as wax; coagulating these until toner particles have a desired diameter; and fusing the binder resin particles, thereby controlling the shape.

The emulsion coagulation method is a method for producing toner particles, including: dropping a binder resin solution dissolved in a solvent to a poor solvent, thereby preparing a resin particle dispersion; mixing the resin particle dispersion with a UV absorber particle dispersion, a colorant particle dispersion, and a releasing agent dispersion of a releasing agent such as wax; and coagulating these until toner particles have a desired diameter; and fusing the binder resin particles, thereby controlling the shape.

The toner in the present invention can be produced by either method.

A case where the emulsion polymerization coagulation method is used as the toner producing method according to the present invention will be described below.

The method includes:

(1) a step of preparing a dispersion in which colorant particles are dispersed in an aqueous medium;

(2) a step of preparing a dispersion in which UV absorber particles are dispersed in an aqueous medium;

(3) a step of preparing a dispersion in which binder resin particles containing an internal additive as needed are dispersed in an aqueous medium;

(4) a step of preparing a dispersion of binder resin particles by emulsion polymerization;

(5) a step of forming toner base particles by mixing the colorant particle dispersion, the UV absorber particle dispersion, and the binder resin particle dispersion, thereby coagulating, associating, and fusing the colorant particles, the UV absorber particles, and the binder resin particles;

(6) a step of removing a surfactant and so forth by filtering the toner base particles from a dispersion system (aqueous medium) of the toner base particles;

(7) a step of drying the toner base particles; and (8) a step of adding an external additive to the toner base particles.

In the case where the emulsion polymerization coagulation method is used as the toner producing method, the binder resin particles obtained by the emulsion polymerization method may have a multilayer structure of two or more layers composed of binder resins different in composition. The binder resin particles having, for example, a two-layer structure can be obtained by a method of: preparing the resin particle dispersion by emulsion polymerization (first polymerization) in accordance with a usual method; adding a polymerization initiator and a polymerizable monomer to the dispersion; and polymerizing (second polymerization) this system.

Toner particles having a core-shell structure can be obtained by the emulsion polymerization coagulation method. More specifically, the toner particles having a core-shell structure can be obtained by: first, preparing core particles by coagulating, associating, and fusing binder resin particles, UV absorber particles, and colorant particles for core particles; and subsequently, adding binder resin particles for a shell layer into a dispersion of the core particles so as to coagulate and fuse the binder resin particles for the shell layer on the surface of the core particles, thereby forming the shell layer with which the surface of the core particles is coated.

<Developer>

The toner according to the present invention may be used as a magnetic single-component toner containing a magnetic material, a two-component developer with, what is called, a carrier mixed, or a nonmagnetic toner alone, any of which can be suitably used in the present invention.

Usable examples of the magnetic material include magnetite, γ-hematite, and various kinds of ferrite.

The carrier in the two-component developer is, for example, magnetic particles of a conventionally known material. Usable examples thereof include: metals such as iron, steel, nickel, cobalt, ferrite, and magnetite; and alloys of these metals with other metals such as aluminum and lead.

Preferably usable examples of the carrier include a coated carrier containing magnetic particles the surface of which is coated with a coating agent such as resin, and, what is called, a resin-dispersed carrier containing magnetic material powder dispersed in a binder resin. The resin for coating is not particularly limited, and examples thereof include olefin resin, styrene resin, styrene-acrylic resin, silicone resin, polyester resin, and fluororesin. Further, the resin for constituting the resin-dispersed carrier is not particularly limited, and usable examples thereof include known resins such as acrylic resin, styrene-acrylic resin, polyester resin, fluororesin, and phenol resin.

The volume-based median diameter of the carrier is preferably in a range of 20 μm to 100 μm and far preferably in a range of 25 μm to 80 μm. The volume-based median diameter of the carrier can be measured, for example, with a laser diffraction particle size analyzer HELOS (manufactured by Sympatec Inc.) provided with a wet-type disperser.

The mixed amount of the toner to the carrier is, taking the total mass of the toner and the carrier as 100 mass %, preferably in a range of 2 to 10 mass %.

EXAMPLES

Hereinafter, the present invention will be more specifically described with Examples. However, the present invention is not limited thereto.

[Toner Producing Method]

<Synthesis of Crystalline Polyester 1>

The following raw material monomers for an addition polymerization resin (styrene-acrylic resin: StAc) unit including a bireactive monomer and a radical polymerization initiator were put in a dropping funnel.

| | |
|---|---|
| styrene | 34 parts by mass |
| n-butyl acrylate | 12 parts by mass |
| acrylic acid | 2 parts by mass |
| polymerization initiator (di-t-butylperoxide) | 7 parts by mass |

The following raw material monomers for a polycondensation resin (crystalline polyester resin: CPEs) unit were put in a four-necked flask equipped with a nitrogen introducing tube, a dehydration tube, a stirrer, and a thermocouple, and heated to 170° C. to be dissolved.

| | |
|---|---|
| sebacic acid | 281 parts by mass |
| 1,12-dodecanediol | 283 parts by mass |

Subsequently, the raw material monomers for the addition polymerization resin (StAc), which had been put in the dropping funnel, were dropped in the four-necked flask while stirred over 90 minutes, and the mixture was aged for 60 minutes. Thereafter, the unreacted raw material monomers for the addition polymerization resin were removed under a reduced pressure of 8 kPa. The amount of the removed monomers was very small compared to the amount of the raw material monomers for the abovementioned resin.

Thereafter, 0.8 parts by mass of $Ti(OBu)_4$ were poured as an esterification catalyst, and the mixture was heated to 235° C., reacted under a normal pressure of 101.3 kPa for five hours, and then further reacted under a reduced pressure of 8 kPa for one hour.

Next, after cooled to 200° C., the mixture was reacted under a reduced pressure of 20 kPa for one hour. Thus, crystalline polyester 1, which is the hybrid crystalline polyester resin, was produced. The crystalline polyester 1 contained, to the total amount, 8 mass % of the resin (StAc) unit other than CPEs, and was resin having a structure in which CPEs was grafted on StAc. The crystalline polyester 1 had a number average molecular weight (Mn) of 9,000 and a melting temperature (Tc) of 75° C.

<Preparation of Crystalline Resin Particle Dispersion (C1)>

30 parts by mass of the crystalline polyester 1 were melted, and the crystalline polyester 1 was transferred in this melted state to an emulsion disperser Cavitron CD1010 (manufactured by Eurotech Co., Ltd.) at a transfer speed of 100 parts by mass per minute. Simultaneously with the transfer of the crystalline polyester 1 in the melted state, diluted ammonia water having a concentration of 0.37 mass % composed of 70 parts by mass of reagent ammonia water diluted with ion exchanged water in an aqueous solvent tank was transferred to the emulsion disperser Cavitron CD1010 (manufactured by Eurotech Co., Ltd.) at a transfer speed of 0.1 L/min while heated to 100° C. with a heat exchanger. This emulsion disperser Cavitron CD1010 (manufactured by Eurotech Co., Ltd.) was operated under the conditions of a rotor's rotational speed of 60 Hz and a pressure of 5 kg/cm$^2$. Thus, a crystalline resin particle dispersion (C1) of the crystalline polyester 1 having a solid content of 30 parts by mass was prepared. The particles contained in the crystalline resin particle dispersion (C1) had a volume-based median diameter of 200 nm.

<Preparation of Amorphous Resin Particle Dispersion (×1)>

(1) First Polymerization

Into a 5 L reaction vessel equipped with a stirrer, a temperature sensor, a cooling tube, and a nitrogen introducing device, 8 parts by mass of sodium dodecyl sulfate and 3,000 parts by mass of ion exchanged water were fed. While the solution was stirred at a stirring speed of 230 rpm under a nitrogen flow, the inner temperature of the reaction vessel was raised to 80° C. After the temperature was raised, a solution of 10 parts by mass of potassium persulfate dissolved in 200 parts by mass of ion exchanged water was added thereto, the liquid temperature was made to be 80° C. again, and a monomer mixture solution having the following composition was dropped thereto over one hour. After the dropping, the resulting solution was heated and stirred at 80° C. for two hours to carry out polymerization. Thus, a resin particle dispersion (×1) was prepared.

| | |
|---|---|
| styrene | 480 parts by mass |
| n-butyl acrylate | 250 parts by mass |
| methacrylic acid | 68 parts by mass |

(2) Second Polymerization

Into a 5 L reaction vessel equipped with a stirrer, a temperature sensor, a cooling tube, and a nitrogen introducing device, a solution of 7 parts by mass of polyoxyethylene-2-dodecyl ether sodium sulfate dissolved in 3,000 parts by mass of ion exchanged water was fed. After the solution was heated to 98° C., 260 parts by mass of the resin particle dispersion (×1) and a solution of the following monomers and releasing agent dissolved at 90° C. were added, and mixed and dispersed for one hour with a mechanical disperser having a circulation route CLEARMIX (manufactured by M Technique Co., Ltd.). Thus, a dispersion containing emulsion particles (oil droplets) was prepared.

| | |
|---|---|
| styrene (St) | 284 parts by mass |
| n-butyl acrylate (BA) | 92 parts by mass |
| methacrylic acid (MAA) | 13 parts by mass |
| n-octyl-3-mercaptopropionate | 1.5 parts by mass |
| releasing agent (behenyl behenate; melting temperature of 73° C.) | 190 parts by mass |

Subsequently, to this dispersion, an initiator solution of 6 parts by mass of potassium persulfate dissolved in 200 parts by mass of ion exchanged water was added, and the system was heated and stirred at 84° C. for one hour to carry out polymerization. Thus, a resin particle dispersion (×2) was prepared.

(3) Third Polymerization

To the resin particle dispersion (×2), 400 parts by mass of ion exchanged water were added and mixed. Thereafter, a solution of 11 parts by mass of potassium persulfate dissolved in 400 parts by mass of ion exchanged water was added thereto. Then, under the temperature condition of 82° C., a monomer mixture solution having the following composition was dropped thereto over one hour. After the dropping, the resulting solution was heated and stirred for two hours to carry out polymerization, and then cooled to 28° C. Thus, an amorphous resin particle dispersion (×1) of vinyl resin (styrene-acrylic resin 1) was prepared.

| | |
|---|---|
| styrene (St) | 350 parts by parts |
| n-butyl acrylate (BA) | 215 parts by mass |
| acrylic acid (AA) | 30 parts by mass |
| n-octyl-3-mercaptopropionate | 8 parts by mass |

Physical properties of the obtained amorphous resin particle dispersion (×1) were measured. The amorphous resin particles had a volume-based median diameter of 220 nm, a glass transition temperature (Tg) of 55° C. and a weight average molecular weight (Mw) of 32,000.

<Preparation of Colorant Particle Dispersion [Bk]>

90 parts by mass of sodium dodecyl sulfate were stirred and dissolved in 1,600 parts by mass of ion exchanged water. While this solution was stirred, 420 parts by mass of carbon black REGAL 330R (manufactured by Cabot Corp.) were gradually added thereto, and subsequently dispersed with a dispersion machine CLEARMIX (manufactured by M Technique Co., Ltd.). Thus, a colorant particle dispersion [Bk] of black colorant particles dispersed was prepared. The volume-based median diameter of the colorant particles in the colorant particle dispersion [Bk] was measured with an electrophoretic light scattering photometer ELS-800 (manufactured by Otsuka Electronics Co., Ltd.), and it was 120 nm.

<Production of Toner T1>

Into a reaction vessel equipped with a stirrer, a temperature sensor and a cooling tube, 195 parts by mass (in terms of solid content) of the amorphous resin particle dispersion (×1) and 2,000 parts by mass of ion exchanged water were poured. Thereafter, a 5 mol/L sodium hydroxide aqueous solution was added to adjust pH to 10.

To the pH-adjusted amorphous resin particle dispersion (×1), 40 parts by mass (in terms of solid content) of the colorant particle dispersion [Bk] were poured. Subsequently, while stirred, an aqueous solution of 30 parts by mass of magnesium chloride as a coagulant dissolved in 60 parts by mass of ion exchanged water was added at 30° C. over 10 minutes. The temperature of this mixed liquid was raised to 60° C. at a temperature rise rate of 0.8° C. per minute, and 20 parts by mass of the crystalline resin particle dispersion (C1) of the crystalline polyester 1 were added thereto over 10 minutes. Further, the temperature thereof was raised to 80° C. at a temperature rise rate of 0.8° C. per minute. The temperature was kept at 80° C. to advance coagulation of the particles, and the particle diameter of the associated particles was measured with Multisizer 3 (manufactured by Beckman Coulter, Inc.). When the volume-based median diameter thereof reached 6.0 μm, an aqueous solution of 190 parts by mass of sodium chloride dissolved in 760 parts by mass of ion exchanged water was added to stop the particle growth. Further, the resulting solution was heated and stirred at 80° C. to advance fusion of the particles. When the average circularity (HPF detection of 4,000 particles) measured with a measuring device FPIA-2100 (manufactured by Sysmex Co.) reached 0.945, the solution was cooled to 30° C. at a cooling rate of 2.5° C. per minute.

The volume-based median diameter of the coagulated particles in the mixed liquid at the time of addition of the crystalline resin particle dispersion (C1) was 0.80 μm. The volume-based median diameter was obtained by calculating the volume mean particle diameter with UPA-150 (manufactured by MicrotracBEL Corp.).

Subsequently, a toner cake obtained by solid-liquid separation and dehydration was washed by repeating a process of re-dispersion in ion exchanged water and solid-liquid separation three times, and thereafter dried at 40° C. for 24 hours. Thus, toner particles were obtained.

To 100 parts by mass of the obtained toner particles, 0.6 parts by mass of hydrophobic silica (a number average primary particle diameter of 12 nm and a hydrophobicity of 68) and 1.0 parts by mass of hydrophobic titanium oxide (a number average primary particle diameter of 20 nm and a hydrophobicity of 63) were added and mixed with a Henschel mixer (Nippon Coke & Engineering Co., Ltd.) at 32° C. for 20 minutes at a rotary blade circumferential speed of 35 mm/sec. Subsequently, coarse particles were removed by using a mesh sieve (filter) having an opening size of 45 μm. Thus, a toner T1 was produced.

<Measurement of Softening Temperature of Toner>

The softening temperature of the toner was measured with a flow tester as described below.

(1) Production of Sample

A sample was produced as follows: placed and flattened out 1.1 g of the toner in a Schale (petri dish) under the environment of a temperature of 20±1° C. and a relative humidity of 50±5%; left the toner for 12 hours or more; applied a pressure of $3.75\times10^8$ Pa (3,820 kg/cm$^2$) to the toner for 30 seconds with a molding machine SSP-A (manufactured by Shimadzu Corporation), thereby producing a cylindrical molded sample having a diameter of 1 cm.

(2) Measurement of Softening Temperature

The softening temperature was measured as follows: set the molded sample in a flow tester CFT-500D (manufactured by Shimadzu Corporation) under the environment of a temperature of 24±5° C. and a relative humidity of 50±20%; after preheating, extruded the molded sample from a hole (1 mm×1 mm) of a cylindrical die with a piston having a diameter of 1 cm with conditions of an applied load of 196 N (20 kgf), an initial temperature of 60° C., a preheating time of 300 seconds and a temperature rising rate of 6° C. per minute; and took, as the softening temperature of the toner, an offset method temperature T (offset) measured by the method of measuring a melting point while increasing temperature, setting an offset value at 5 mm.

As a result, the softening temperature of the toner 1 was 99° C.

<Production of Developer 1>

With the toner T1, a ferrite carrier coating a copolymer resin of cyclohexyl methacrylate and methyl methacrylate (monomer mass ratio=1:1) and having a volume mean particle diameter of 30 μm was mixed for 30 minutes with a V-type mixer so as to be a toner concentration of 6 mass %. Thus, a developer 1 was produced.

<Preparation of Evaluation Instrument>

(Preparation of Evaluation Instrument 1)

As an evaluation instrument (electrophotographic image forming apparatus), bizhub PRESS C1080 manufactured by Konica Minolta, Inc. was prepared. Apart from this, the image post-processing apparatus including the glossiness control unit 100 of the present invention shown in FIG. 5 was prepared. As shown in FIG. 5, the glossiness control unit 100 includes the heater 101A as the non-contact heating device and the controller 102. As the heater 101A as the non-contact heating device, one constituted of a carbon heater as a heat source installed in a heat-insulating cover was used.

(Preparation of Evaluation Instrument 2)

As an evaluation instrument (electrophotographic image forming apparatus), bizhub PRESS C1080 manufactured by Konica Minolta, Inc. was prepared. Apart from this, the image post-processing apparatus including the glossiness control unit 100 of the present invention shown in FIG. 6 was prepared. As shown in FIG. 6, the glossiness control unit 100 includes the heating plate 101B as the non-contact heating device and the controller 102. The heating plate 101B as the non-contact heating device is arranged, as shown in FIG. 6, at a position where the heating plate 101B can heat recording media from a side of the recording media, the side where toner images are not formed.

(Preparation of Evaluation Instrument 3)

As an evaluation instrument (electrophotographic image forming apparatus), bizhub PRESS C1080 manufactured by Konica Minolta, Inc. was prepared. Apart from this, the image post-processing apparatus including the glossiness control unit 100 of the present invention shown in FIG. 7 was prepared. As shown in FIG. 7, the glossiness control unit 100 includes the light emitter 101C as the non-contact heating device and the controller 102. The light emitter 101C used LEDs having a maximum emission wavelength of 365 nm (365 nm±20 nm) as the light source.

(Preparation of Evaluation Instrument 4)

Figure 10:
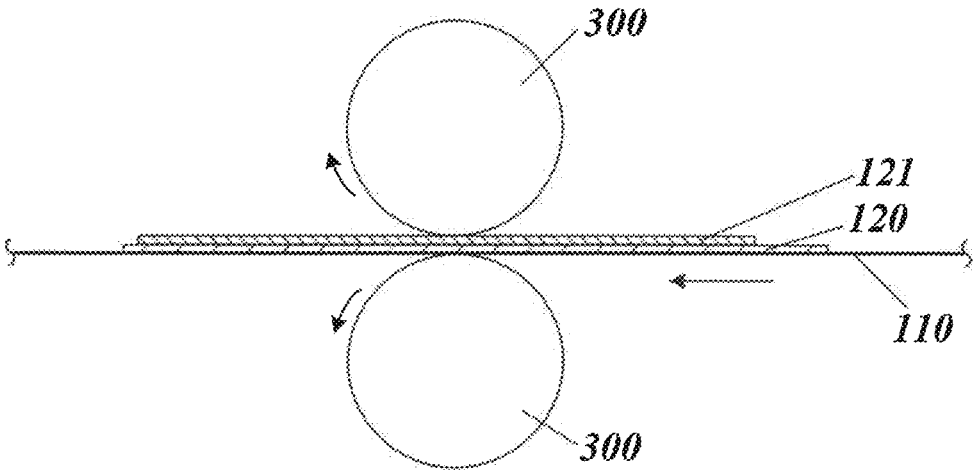
FIG. 10 is a schematic view showing a pair of heating rollers as a contact heating device used in a comparative example.

An evaluation instrument prepared was the same as the evaluation instrument 1 except that a pair of heating rollers 300 (shown in FIG. 10) was used instead of the heater 101A. As shown in FIG. 10, the heating rollers 300 can perform heating while applying pressure from both sides of a recording medium 120. Because this pair of the heating rollers 300 heats a toner image 121 while contacting the toner image 121, it is a contact heating device and not included in the scope of the non-contact heating device in the present invention.

[Image Post-processing Condition 1]

In the evaluation instrument 1, a solid toner image formed by containing the developer 1 was fixed to an A3 coated sheet (basis weight of 128 g/m$^2$) as a recording medium, so that an evaluation target image was obtained. The evaluation target image was post-processed by the image post-processing apparatus in the evaluation instrument 1. More specifically, the image was moved by a conveyor to the glossiness control unit 100, and heated in a non-contact manner by setting output of the carbon heater as the non-contact heating device such that the surface temperature of the toner image became 80° C.

[Image Post-processing Condition 2]

In the evaluation instrument 2, a solid toner image formed by containing the developer 1 was fixed to an A3 coated sheet (basis weight of 128 g/m$^2$) as a recording medium, so that an evaluation target image was obtained. The evaluation target image was post-processed by the image post-processing apparatus in the evaluation instrument 2. More specifically, the image was moved by the conveyor to the glossiness control unit 100, and heated by the heating plate 101B such that the surface temperature of the toner image became 80° C. The heating plate 101B had been arranged so as to heat the recording medium from the side opposite to the side where the toner image was fixed. Hence, the heating plate 101B did not contact the toner image.

[Image Post-processing Condition 3]

In the evaluation instrument 3, a solid toner image formed by containing the developer 1 was fixed to an A3 coated sheet (basis weight of 128 g/m$^2$) as a recording medium, so that an evaluation target image was obtained. The evaluation target image was post-processed by the image post-processing apparatus in the evaluation instrument 3. More specifically, the image was moved by the conveyor to the glossiness control unit 100, and the light emitter 101C emitted light to the toner image with a light amount with which the surface temperature of the toner image became 80° C. As to the light emission, the light emitter 101C using the LEDs having a maximum emission wavelength of 365 nm (365 nm±20 nm) in the evaluation instrument 3 emitted light to the surface of the toner image with a light amount of 2.0 J/cm$^2$, to be specific.

[Image Post-processing Conditions 4 to 6]

Image post-processing conditions 4 to 6 were each the same as the image post-processing condition 1 except that the output of the heater used as the non-contact heating device was changed such that the surface temperatures of the toner images became those shown in TABLE I.

[Image Post-processing Condition 7]

In the evaluation instrument 4, a solid toner image formed by containing the developer 1 was fixed to an A3 coated sheet (basis weight of 128 g/m$^2$) as a recording medium, so that an evaluation target image was obtained. The temperature of the heating rollers 300 was set such that the surface temperature of the toner image became 80° C., and the toner image was heated while pressed at a pressure of 0.3 MPa.

<Evaluation of Change in Glossiness>

With respect to each of the toner images before and after the image post-processing, the glossiness (%) at an incident angle of 60° was measured at three points in total on the toner image with a gloss meter (Multi Gloss 268Plus manufactured by Konica Minolta, Inc.), and the average value thereof was taken as the glossiness (%). The three points were: the center point of the image; and one point in each direction of the short axis direction of the recording medium at an interval of 50 mm from the center point of the image.

In addition, the absolute value of the difference between the glossiness of each toner image before the image post-processing and the glossiness of the toner image after the image post-processing was calculated. The glossiness difference being 3% or more was regarded as a pass, whereas the glossiness difference being less than 3% was regarded as a fail. The evaluation result is shown in TABLE I.

<Evaluation of Gloss Unevenness>

With respect to each toner image after the image post-processing, gloss unevenness was visually evaluated by sensory evaluation in accordance with the criteria below. The evaluation result is shown in TABLE I.

x (cross): gloss unevenness is clearly visible, and it is a problem in practical use Δ (triangle): gloss unevenness is visible, but it is not a problem in practical use ○ (circle): gloss unevenness is slightly visible, but it is not a problem in practical use ◎ (double circle): gloss unevenness is not visible at all

[Table I]

TABLE I

| IMAGE POST-PROCESSING CONDITION | SOFTENING TEMPERATURE OF TONER [° C.] | GLOSSINESS ADJUSTMENT CONDITION: NON-CONTACT HEATING DEVICE | GLOSSINESS ADJUSTMENT CONDITION: TONER IMAGE SURFACE TEMPERATURE AFTER HEATING [° C.] | BEFORE IMAGE POST-PROCESSING GLOSSINESS [%] | AFTER IMAGE POST-PROCESSING GLOSSINESS [%] | EVALUATION: CHANGE IN GLOSSINESS | EVALUATION: GLOSS UNEVENNESS | REMARK |
|---|---|---|---|---|---|---|---|---|
| 1 | 99 | HEATER | 80 | 42 | 26 | PASS | ◎ | PRESENT INVENTION |
| 2 | 99 | HEATING PLATE | 80 | 42 | 28 | PASS | ◎ | PRESENT INVENTION |
| 3 | 99 | LIGHT EMITTER | 80 | 42 | 26 | PASS | ◎ | PRESENT INVENTION |
| 4 | 99 | HEATER | 140 | 42 | 53 | PASS | ◎ | PRESENT INVENTION |
| 5 | 99 | HEATER | 69 | 42 | 38 | PASS | ◎ | PRESENT INVENTION |
| 6 | 99 | HEATER | 199 | 42 | 58 | PASS | ○ | PRESENT INVENTION |
| 7 | 99 | *1 | 80 | 42 | 43 | FAIL | ◎ | COMPARATIVE EXAMPLE |

*1: A PAIR OF HEATING ROLLERS AS CONTACT HEATING DEVICE WAS USED.

From the results shown in TABLE I, it is known that the image post-processing method of the present invention can adjust the glossiness of toner images fixed to recording media by heating the toner images with the non-contact heating device, which is configured to heat toner images fixed to recording media to the temperature which reduces the glossiness of the toner images. It is also known therefrom that the image post-processing method of the present invention can keep gloss unevenness low, and hence has no problem in practical use.

Meanwhile, the image post-processing method of the comparative example, which used a pair of heating rollers, was unable to adjust the glossiness. The reason is considered as follows: although the toner image was heated such that the toner was softened, it was also pressed, and consequently irregularity on the surface of the image was uncontrollable.

Further, because the image post-processing method of the present invention can adjust the glossiness of the fixed toner images by heating the toner images in the non-contact manner, it can control the glossiness with no influence on the fixability of the toner images.

Although one or more embodiments of the present invention have been described and shown in detail, the disclosed embodiments are made for purposes of illustration and example only and not limitation. The scope of the present invention should be interpreted by terms of the appended claims.

The entire disclosure of Japanese Patent Application No. 2017-232240 filed on Dec. 4, 2017 is incorporated herein by reference in its entirety.

What is claimed is:

1. An image post-processing method for adjusting glossiness of a fixed toner image, comprising:

a glossiness control step of, with a non-contact heating device configured to heat a toner image fixed to a recording medium to a temperature which reduces glossiness of the fixed toner image, heating the toner image fixed to the recording medium so as to reduce the glossiness of the toner image, wherein the glossiness control step of heating includes heating the toner image fixed to the recording medium to a softening temperature that softens and does not re-melt a toner that constitutes the toner image and the toner image fixed to the recording medium is not directly contacted during the glossiness control step.

2. The image post-processing method according to claim 1, wherein the non-contact heating device is further configured to heat the toner image fixed to the recording medium to a temperature which increases the glossiness of the toner image, and the glossiness control step includes a step of, with the non-contact heating device, heating the toner image fixed to the recording medium so as to reduce or increase the glossiness of the toner image.

3. The image post-processing method according to claim 1, wherein a surface temperature of the toner image when the glossiness of the toner image is reduced is equal to or lower than a softening temperature of the toner constituting the toner image.

4. The image post-processing method according to claim 2, wherein a surface temperature of the toner image when the glossiness of the toner image is reduced or increased is in a range of −30° C. to +100° C., inclusive, of the softening temperature of the toner constituting the toner image.

5. The image post-processing method according to claim 1, wherein the glossiness control step includes a temperature control step of adjusting a surface temperature of the toner image with the non-contact heating device based on glossiness information specified by a user.

6. The image post-processing method according to claim 5, wherein in the temperature control step, the surface temperature of the toner image is adjusted based on relationship information on change in the glossiness of the toner image with respect to the surface temperature of the toner image.

7. The image post-processing method according to claim 1, further comprising, before the glossiness control step, a step of detecting the glossiness of the toner image fixed to the recording medium.

8. An image post-processing apparatus for adjusting glossiness of a fixed toner image, comprising:

a non-contact heating device configured to heat a toner image fixed to a recording medium to a temperature which reduces glossiness of the toner image; and a hardware processor which causes the non-contact heating device to heat the toner image fixed to the recording medium so as to reduce the glossiness of the toner image, wherein the non-contact heating device heats the toner image fixed to the recording medium to a softening temperature that softens and does not re-melt a toner that constitutes the toner image and the toner image fixed to the recording medium is not directly contacted when the non-contact heating device heats the toner image.

9. The image post-processing apparatus according to claim 8, wherein the non-contact heating device is further configured to heat the toner image fixed to the recording medium to a temperature which increases the glossiness of the toner image, and the hardware processor causes the non-contact heating device to heat the toner image fixed to the recording medium so as to reduce or increase the glossiness of the toner image.

10. An image forming apparatus which forms an electrophotographic image, comprising:

a transfer unit which transfers, onto a recording medium, a toner image formed in a developing unit;

a fixing unit which fixes the toner image to the recording medium;

a non-contact heating device configured to heat the toner image fixed to the recording medium to a temperature which reduces glossiness of the toner image; and a hardware processor which causes the non-contact heating device to heat the toner image fixed to the recording medium so as to reduce the glossiness of the toner image, wherein the non-contact heating device heats the toner image fixed to the recording medium to a softening temperature that softens and does not re-melt a toner that constitutes the toner image and the toner image fixed to the recording medium is not directly contacted when the non-contact heating device heats the toner image.

11. The image forming apparatus according to claim 10, wherein the non-contact heating device is further configured to heat the toner image fixed to the recording medium to a temperature which increases the glossiness of the toner image, and the hardware processor causes the non-contact heating device to heat the toner image fixed to the recording medium so as to reduce or increase the glossiness of the toner image.

12. An image forming apparatus which forms an electrophotographic image, comprising:

a transfer unit which transfers, onto a recording medium, a toner image formed in a developing unit; and a fixing unit which fixes the toner image to the recording medium, wherein the image post-processing apparatus according to claim 8 is attached to the image forming apparatus.

13. The image post-processing apparatus according to claim 1, further comprising a temperature detecting step of detecting a temperature of the toner image fixed to the recording medium with a temperature detector disposed downstream of the heating device.

14. The image post-processing apparatus according to claim 1, wherein the non-contact heating device is selected from a group consisting of a device for heating by infrared rays, a device for heating by hot blowing air, a heating plate, and a device for heating by light emission.

* * * * *